United States Patent [19]

Uchida et al.

[11] Patent Number: 4,782,886

[45] Date of Patent: Nov. 8, 1988

[54] DEGASSING APPARATUS FOR A METAL MOLD

[75] Inventors: Masashi Uchida; Minoru Kuriyama, both of Yamaguchi, Japan

[73] Assignee: UBE Industries, Ltd., Japan

[21] Appl. No.: 114,643

[22] Filed: Oct. 28, 1987

[30] Foreign Application Priority Data

Nov. 4, 1986 [JP] Japan ..... 61-260715
Nov. 4, 1986 [JP] Japan ..... 61-260716

[51] Int. Cl.[4] ..... B22D 17/70

[52] U.S. Cl. ..... 164/305; 164/410; 425/420; 425/812

[58] Field of Search ..... 164/305, 410, 312; 425/420, 812

[56] References Cited

U.S. PATENT DOCUMENTS 4,431,047 2/1984 Takeshima et al. .
4,489,771 12/1984 Takeshima et al. .
4,691,755 9/1987 Kuriyama et al. .
4,722,385 2/1988 Yamauchi et al. ..... 164/305

*Primary Examiner*—Kuang Y. Lin
*Attorney, Agent, or Firm*—Darby & Darby

[57] ABSTRACT

Disclosed is a degassing apparatus incorporated with a molding apparatus having a mold cavity, which includes a spool having a bore formed therein. The spool further has formed therein a gas inlet opening adapted to be communicatively coupled to the mold cavity of the molding apparatus, and a gas outlet opening, the gas inlet and outlet openings being in selective communication and non-communication with each other. Means for selectively controlling the communication and non-communication between the gas inlet and gas outlet openings, are provided. Also provided is a flanged piston mounted in the bore and coupled to the communication controlling means, the piston being reciprocatingly slidable between a first position and a second position, the bore being further formed with an upper chamber and a rod-side chamber situated on opposite axial sides of the piston, and a lower chamber radially surrounding a portion of said piston. The spool further includes first, second and third fluid ports formed therein, the ports being in communication with the upper, rod-side and lower chambers respectively, the lower chamber being in communication with said rod-side chamber when said piston is in the second position, wherein the gas inlet and outlet openings are in non-communication, and the lower chamber being in non-communication with the rod-side chamber when the piston is in the first position, wherein the gas inlet and outlet openings are in communication.

33 Claims, 18 Drawing Sheets

DEGASSING APPARATUS FOR A METAL MOLD

BACKGROUND OF THE INVENTION

The present invention relates to a degassing apparatus for a metal mold which degasses a cavity of the metal mold during injection molding by an injection molding apparatus, a die-cast machine or the like.

In a conventional injection molding apparatus, for example, a die-cast machine, when molten metal is charged in the mold cavity at high speed and high pressure, gas in the mold cavity often cannot be sufficiently removed and may become mixed with the molten metal used to form a product, thus forming a void in the molded product.

U.S. Pat. No. 4,431,047 ('047 patent) describes a degassing apparatus for a metal mold which can remove a large volume of gas within a short period of time. The degassing apparatus comprises a vent groove formed on the dividing or mating surfaces of the metal mold. The vent groove communicates with the mold cavity.

The apparatus described in the '047 patent also includes a valve having a reciprocatingly movable valve body, and a bypass conduit which provides an exhaust path from the mold cavity. The bypass conduit joins the vent groove midway along its length and connects with the valve. The valve body may be moved between an open and closed position. In the pen position, the valve body allows gas from the bypass conduit to pass freely through the valve. In the closed position, the valve body blocks the bypass conduit and the vent groove so that no molten metal may pass into the valve. The valve body is positioned in line with the vent groove at an end of the groove that is distal from the mold cavity.

The degassing apparatus of the '047 patent allows gas in the mold cavity to escape during injection molding through the bypass conduit and the valve. When molten metal is charged in the cavity and reaches the end of the vent groove, the molten metal has sufficient mass to push the valve body from the open position to the closed position, whereupon the bypass conduit and vent groove are closed so that no molten metal can escape.

Although the degassing apparatus described in the '047 patent works satisfactorily in many applications, it has a number of inherent drawbacks.

One of the problems when injection molding with molten metal is that, like similar liquids, it travels in waves or splashes, so that its flow may be discontinuous. This is especially true when splashes or droplets of molten metal are entrained by the air escaping the mold cavity, which droplets comprise the leading wave of molten metal flow impinging the valve body.

The droplets of molten metal may not have sufficient mass to move the valve body completely from the open position to the closed position. In fact, a compression spring biasing the valve body towards the open position may reopen the valve after the first droplets of molten metal have impinged the valve body and upon the arrival of further gas escaping from the mold cavity through the bypass conduit.

When a subsequent, more continuous wave of molten metal reaches the valve body, the first leading droplets may have already begun to solidify within the vent groove and may form a constriction within the vent groove. Thus, the "after wave" of molten metal may not be capable of impinging the valve body with sufficient kinetic force to fully close the valve. As a result, molten metal may enter the valve through the bypass conduit.

U.S. Pat. No. 4,489,771 ('771 patent) discloses a degassing apparatus having a valve and a valve body, a tension spring for biasing the valve body in a closed position, and a leaf spring or a compression spring, a ball and a cooperating detent formed in the valve body for releasably locking the valve body in an open position. When molten metal impinges the valve body, it overcomes the pressure of the spring and ball, which is seated in the detent, and frees the valve body to move to the closed position, thus closing the valve. The valve can be quickly and reliably closed when the first wave of molten metal impinges the valve body.

An inherent disadvantage of the degassing apparatus of the '771 patent is that it relies on the mechanical forces between the biased ball and valve body detent to maintain the valve body in an open position. Such mechanical forces may vary as the leaf spring biasing the ball weakens, or due to undue wear on the ball or the detent in which the ball is seated. The valve may close prematurely as the locking mechanism weakens, which may prevent gas from the mold cavity from escaping.

Alternatively, if the leaf spring or other components of the locking mechanism become roughened or deformed, an unusually high kinetic force may be needed to dislodge the ball from the valve body detent. The molten metal impinging the valve body may not have sufficient kinetic force to close the valve, thus allowing the metal to flow into the valve.

Thus, the degassing apparatus of the '771 patent may not be able to withstand the strenuous and continual degassing operation that is required in mass production injection molding processes, and may have an unusually short operational life due to its mechanical wear.

In U.S. Pat. No. 4,691,755 issued on Sept. 8, 1987, and assigned to the assignee of the present application, a degassing apparatus for a metal mold is disclosed. In this application, a valve mechanism is provided for selectively opening and closing a gas vent for the degassing of a metal mold. The valve mechanism includes a seatable valve head connected to a shaft, which in turn terminates in a piston slidable within a bore, which in turn is positioned in a spool.

The bore is further formed with first and second chambers situated on opposite axial sides of the piston. The spool further includes first, second and third fluid ports formed therein. The first and second ports are in communication with the first and second chambers, respectively.

The piston further includes at least one first channel formed therein and interconnecting the first and second chambers, and a second channel interconnecting the third port and the first chamber when the piston is in a first, upward position. The third port and the first chamber are not in communication when the piston is in a second, lowered position. A pressurized fluid is provided selectively to the first, second and third fluid ports. By changing which ports receive the pressurized fluid, the piston may be made to move between the first and second positions or may be maintained in one of the positions.

Although the invention of the '755 patent represents a significant advance in the art, there are a few aspects of that invention which are disadvantageous. First, the system for regulating which ports receive pressurized fluid, and timing when the ports receive the pressurized fluid, is rather complicated. Second, the piston of the '755 patent is bored with two separate channels. Thus, the piston is weakened, and the strength and useful life of the piston is reduced.

SUMMARY OF THE INVENTION

It is an object of the present invention to provide a degassing apparatus for use in a metal molding apparatus which has high mechanical strength and increased reliability over conventional degassing apparatuses.

It is another object of the present invention to provide a degassing apparatus having a highly sensitive valve which will close with accurate repeatability upon the impingement by molten metal.

It is a further object of the present invention to provide a degassing apparatus which includes a mechanically simplified valve closing mechanism.

It is yet another object of the present invention to provide a degassing apparatus having an extended operating life.

It is a still further object of the present invention to provide a degassing apparatus which overcomes the inherent disadvantages of known degassing apparatuses.

It is still another object of the present invention to provide a degassing apparatus having a valve which is closed not only by the inertial force of a molten metal but also by an electrical signal during or before an injection molding process.

In accordance with one embodiment of the present invention, the degassing apparatus, which is adapted for use in a molding apparatus having a mold cavity, includes a spool having a bore formed longitudinally therein. The spool also has formed therein a gas inlet opening adapted to be communicatively coupled to the mold cavity of the molding apparatus, and a gas outlet opening.

The gas inlet and outlet openings are in selective communication and non-communication with each other. Thus, the apparatus will permit gas from the mold cavity to escape until such time as molten metal or other molding material reaches the degassing apparatus.

The degassing apparatus also includes a mechanism for selectively controlling the communication and non-communication between the gas inlet and gas outlet openings. In a preferred form of the invention, this mechanism may be in the form of a reciprocatingly slidable valve body which engages a conforming valve seat formed on the spool.

The degassing apparatus further has a flanged piston mounted in the bore and coupled to the valve body or other inlet/outlet communication controlling mechanism. The flanged piston is reciprocatingly slidable between a first position and a second position.

The bore is further formed with first and second chambers situated on opposite axial sides of the piston.

The spool further includes first, second and third fluid ports formed therein. The first and second ports are in communication with the first and second chambers, respectively.

The third port is in communication with the second chamber, but not the first chamber, when the flanged piston is in the first (valve open) position. However, when the flanged piston is in the second (valve closed) position the third port is not in communication with either the first or second chamber.

A pressurized fluid is provided selectively to the first, second and third fluid ports. In one form of the invention, by changing which ports receive the pressurized fluid, the piston may be made to move between the first and second positions or may be maintained in one of the positions. Alternatively, the degassing apparatus of the present invention is adapted to close upon molten material impinging the inlet/outlet communication controlling mechanism, such as the valve body. Furthermore, the valve may be closed not only by the inertial force of the molten metal but also by an electrical signal during or before an injection molding process. The electrical signal may be used to assist closing the valve by the inertial force of the molten body, or alternatively, the electrical force alone may be used to close the valve.

Preferred forms of the degassing apparatus, as well as other objects, features and advantages of this invention, will become apparent from the following detailed description of illustrative embodiments thereof, which is to be read in connection with the accompanying drawings.

DETAILED DESCRIPTION OF THE PREFERRED EMBODIMENTS

FIGS. 1 to 5 show one embodiment of the present invention in which a degassing apparatus for a metal mold is applied to a metal mold of a die-cast machine (or other molding apparatus).

Figure 3:
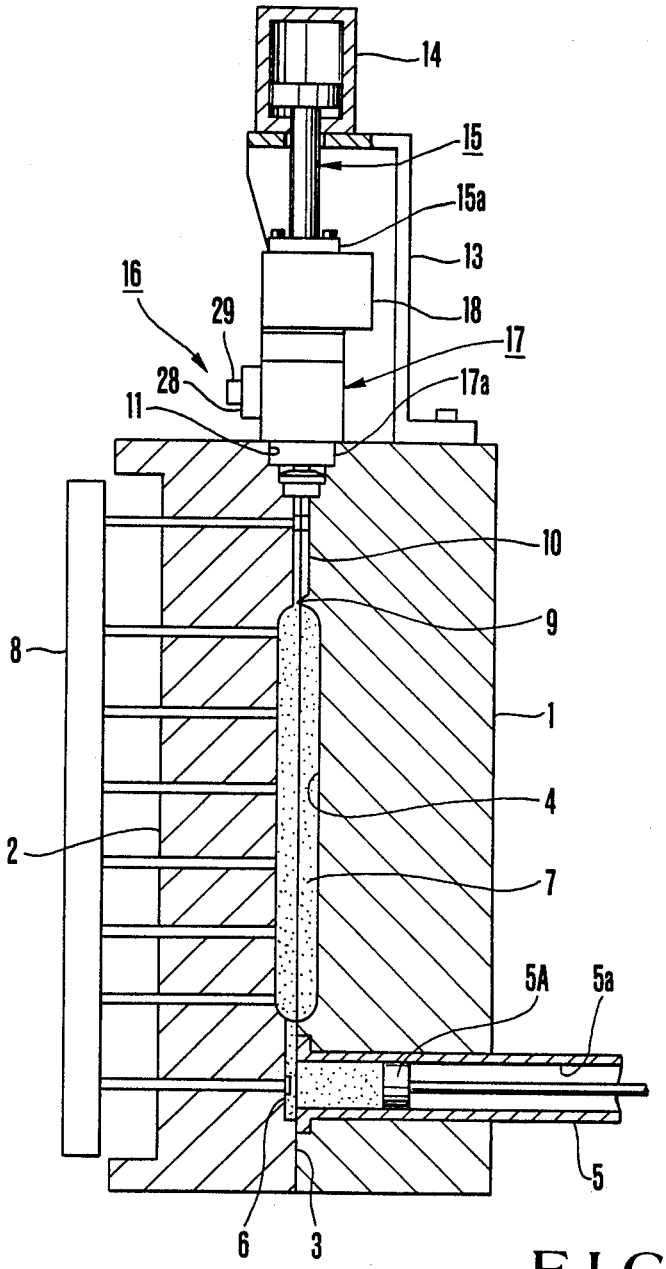
FIG. 3 is a partially cut away front view of the degassing apparatus and a molding apparatus.

As shown in the drawings, a typical molding apparatus includes a cavity 4 (FIG. 3) which is formed in two sides of a dividing surface 3 at the junction between a stationary metal mold 1 and a movable metal mold 2. The molding apparatus of FIG. 3 is illustrated in a closed state. A molten metal 7 is injected and charged in the cavity 4 from an injection sleeve 5 and a gate 6. Reference numeral 8 denotes a product pushing device for pushing out a molded product obtained by solidifying the molten metal 7 from the cavity 4 of the movable metal mold 2 after the molds are opened or separated. A spool hole 11 communicating with the cavity 4 through a vent path 9, and a vent groove 10 formed between the vent path 9 and the spool hole 11 are provided in the upper end portion of the dividing surface 3 of the metal molds 1 and 2. A bypass conduit 12 (FIG. 1) branching midway along the vent groove 10 communicates with a portion of the vent groove 10, which is open to the spool hole 11.

A fluid pressure cylinder 14 is fixed to a bracket 13 that is mounted on the upper surface of the stationary metal mold 1 and is preferably concentric with the vent groove 10. A holder 18 for clamping the upper end portion of a spool 17 of the degassing apparatus (indicated generally by reference numeral 16) is mounted on a flange 15*a*, which serves as an operating end of a piston rod 15. The piston rod 15 reciprocates within the cylinder 14 by varying the fluid pressure within the cylinder 14.

Figure 4:
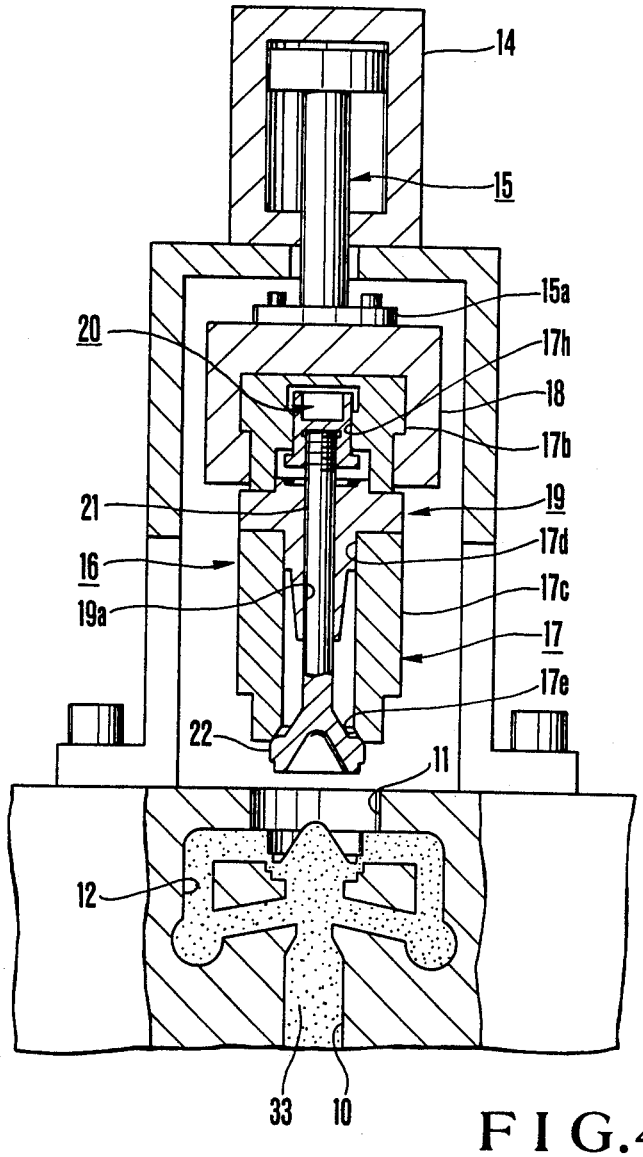
FIG. 4 is a longitudinal sectional view of the degassing apparatus shown in FIG. 1 separated from the molding apparatus.

The spool 17 of the degassing apparatus is preferably formed in a cylindrical shape at its lower end, and includes a stepped portion 17*a* at its lower end. Upon reciprocal movement of the piston rod 15, the entire degassing apparatus 16 moves vertically, so that the stepped portion 17*a* is received by the conforming spool hole 11 (so as to be in an enabled state), or is separated from the spool hole 11 (so as to be in a disabled state), as shown in FIG. 4.

Figure 1:
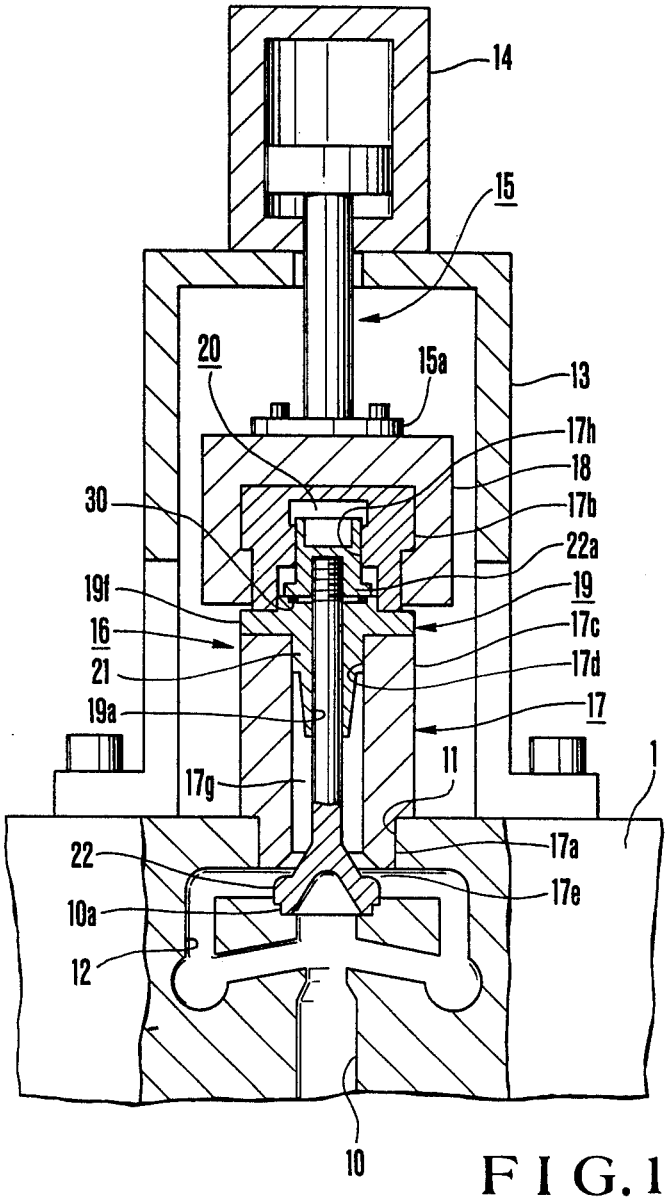
FIG. 1 is a longitudinal sectional view of the degassing apparatus of the present invention in accordance with one preferred embodiment thereof.

The degassing apparatus 16 will now be described with reference to FIGS. 1 to 3, which illustrate the apparatus in an enabled state.

In a preferred form, the spool 17 is divided into upper and lower members 17*b* and 17*c* and a flange 19*f* which is fitted in an inner hole or bore 17*d* of a valve guide 19 and is clamped therebetween, thus integrating the upper and lower members 17*b* and 17*c* with the valve guide 19. Reference numeral 20 denotes a flanged piston which is located above the valve guide 19 and is slidably fitted in the inner hole 17*h* of the spool 17. The threaded portion of a valve rod 21, which is slidably fitted in an inner hole or bore 19*a* of the valve guide 19, is screwed in the central threaded hole of the piston 20.

A valve body 22 is integrally formed on the lower end of the valve rod 21. A valve seat 17*e* is formed in a lower opening end of the spool 17. The valve body 22 and the valve seat 17*e* are arranged so that molten metal 7 moving upward along the vent groove 10 pushes the valve body 22 from the valve open state shown in FIG. 1 to a closed state, and the valve body 22 moves upward, thus closing the valve. In the valve open state shown in FIG. 1, the valve body 22 engages an opening stepped portion 10*a* of the vent groove 10 to close it. In FIG. 2, reference numeral 17*f* denotes a gas outlet opening for externally exhausting gas from the mold cavity 4 which is guided to a valve chamber 17*g* of the spool 17, which is defined by the inner hole 17*d* and the valve guide 19, in the valve open state.

The degassing apparatus 16 of the present invention in the preferred form described above has a pneumatic pressure type holding mechanism for keeping the valve body 22 in both the valve open state and the valve closed state, or alternatively, for causing the valve to open and close. More specifically, as shown in FIG. 2, adjacent to the flanged piston 20 is a head-side chamber 23 above the piston, a lower chamber 24*a* surrounding the lower, flanged portion of the piston 20 and a rod-side chamber 24*b* below the piston. When valve 22 is in the open position, piston 20 rests on stepped up portion 19*g* of valve guide 19. Stepped up portion 19*g* surrounds annular rod-side chamber 24*b*. O-ring 30 is seated in rod-side chamber 24*b* and seals piston 20 against valve guide 19. Thus, when valve 22 is in the open position, lower chamber 24*a* and rod-side chamber 24*b* are separated by the seal maintained by piston 20 and O-ring 30.

Three ports provide access through the side of bracket 18 and the wall of spool 17 to the three chambers adjacent to piston 20. Upper outer port 25*b* in bracket 18 is in fluid communication with upper inner port 25*a* in spool 17. Upper inner port 25*a* in turn communicates with head-side chamber 23. Middle outer port 26*b* in bracket 18 is in fluid communication with middle inner port 26*a*. Middle inner port 26*a* in turn communicates with lower chamber 24*a*. Lower port 27 penetrates through the outer wall of valve guide 19 and communicates with rod-side chamber 24*b*.

In the preferred form of the invention, the diameter of the piston 20 is e.g., 30 mm.

Figure 2:
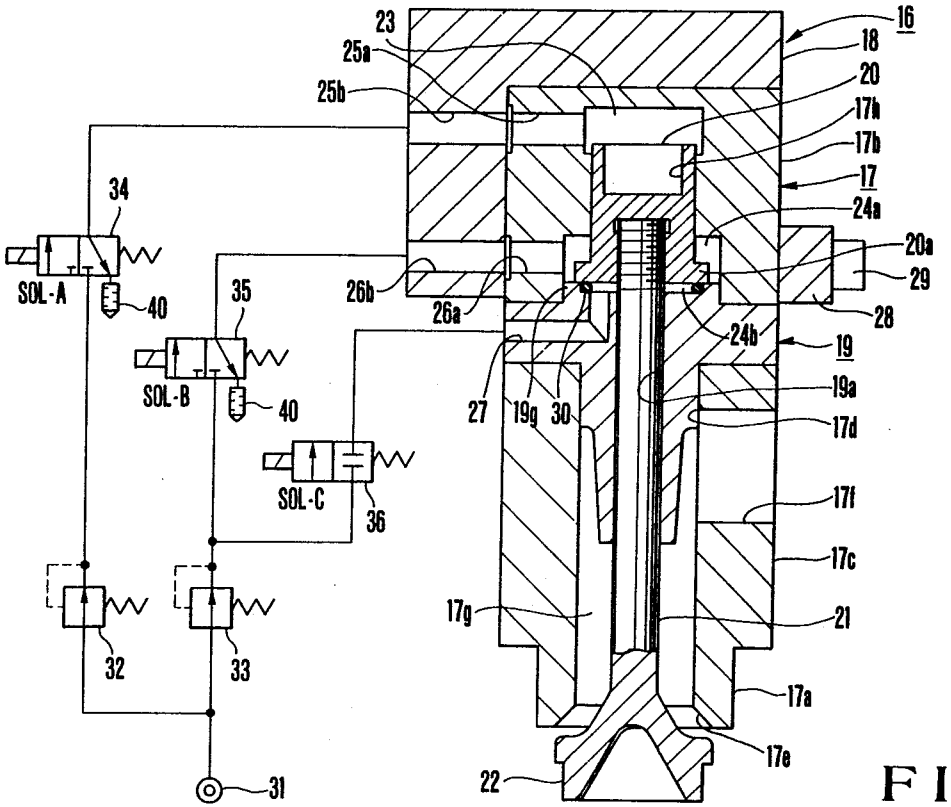
FIG. 2 is a longitudinal sectional view of the degassing apparatus of FIG. 1 and a pneumatic circuit diagram of a pneumatic control circuit adapted for use with the degassing apparatus.

A pneumatic circuit for opening and closing the valve is illustrated by FIG. 2. A switching valve 34 comprising solenoid SOL-A is arranged in series with a pipe or conduit connecting port 25*b* and a source of pressurized air 31. A switching valve 35 comprising a solenoid SOL-B is arranged in series with conduits connecting the port 26*b* and the air source 31. A switching valve 36 comprising a solenoid SOL-C is arranged in series with lower port 27 and air source 31. Reference numeral 32 denotes a reducing valve or regulator for supplying a regulated supply of air to port upper port 25*b*. Reducing valve 33 supplies a regulated supply of air to ports 26*b* and 27.

Switching valves 34, 35 and 36 control the flow of pressurized air from source 31 to ports 25*b*, 26*b* and 27, respectively. When solenoid SOL-A of valve 34 is de-energized as shown in FIG. 2, port 25*b* (and thus head-side chamber) is able to communicate through the conduit to ambient air, and is therefore open to atmospheric pressure. Likewise, when SOL-B is de-energized as shown in FIG. 2, port 26*b*, (and thus middle chamber 24*a*)is able to communicate through the conduit to ambient air, and is therefore open to atmospheric pressure. The openings to atmospheric pressure at SOL-A and SOL-B include an exhaust muffler 40 to muffle the sound of escaping air.

When SOL-C of switching valve 36 is in the de-energized state as shown in FIG. 2, the valve 36 is closed and port 27 (and thus rod-side chamber 24*b*) is not able to communicate with the pressurized air source 31 via the reducing valve 33.

Strictly speaking, the valve rod 21 is slidable along the valve guide 19. If pressurized air is present in the rod-side chamber 24*b*, the pressurized air passes through a gap between the valve rod 21 and the valve guide 19 and is exhausted in the outer atmosphere through the valve chamber 17*g*. Therefore, when a predetermined period of time has elapsed, the rod-side chamber 24*b* is set at the atmospheric pressure.

The operation of the degassing apparatus described above, in conjunction with the operation of the molding apparatus illustrated by FIG. 3, will now be described in detail.

After the metal molds are closed, solenoid SOL-A of switching valve 34 is energized and solenoids SOL-B and SOL-C of switching valves 35 and 36, respectively (see FIG. 2) are de-energized. As a result, pressurized air flows from air source 31 to port 25*b* to head-side chamber 23, exerting pressure on piston 20. Since SOL-B and SOL-C are de-energized, air in lower chamber 24*a* and rod-side chamber 24*b* is exposed to ambient air and are at atmospheric pressure. As a result, piston 20 and associated rod 21 and valve head 22 ar forced downward until piston 20 seals against O-ring 30. When the piston 20 is in this position, valve body 22 is separated from the valve seat 17*e* and the bypass conduit 12 allows gas from the mold cavity 4 to escape through the bypass conduit 12 into the valve. Since the valve is maintained in the valve open state by pneumatic pressure, the valve body 22 will not close inadvertently.

After the valve has been positioned in the open state, solenoid SOL-B may be energized so that pressurized air flows into port 26*b* and lower chamber 24*a*. Because the seal between piston 20 and O-ring 30 separates rod-side chamber 24*b* and lower chamber 24*a*, the pressure in rod-side chamber 24*b* is unaffected by the pressurized air.

Figure 5:
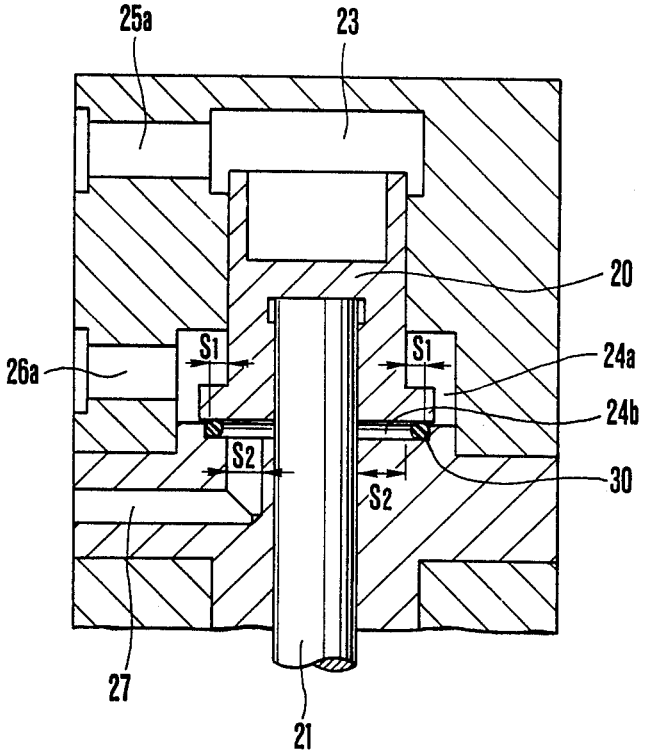
FIG. 5 is a longitudinal, enlarged sectional view of the present invention in accordance with a preferred embodiment thereof.

Referring to FIGS. 2 and 5, it can be seen that the pressure exerted by the air introduced to lower chamber 24*a* acts to maintain piston 20 in the lowered, first position. This is due to the fact that the force exerted on the piston 20 is equal to the air pressure within a respective chamber multiplied by the area of the chamber. Applying this principle to lower chamber 24*a*, because the chamber is symmetrical and the forces are equal and opposite, most of forces cancel out. However, some of the force does not cancel out. The area defined in FIG. 5 as $S_1$ refers to the surface area of the flanged portion of piston 20 which does not have a corresponding surface below the piston 20 because O-ring 30 seals the underside of the piston from the pressure introduced at port 26*a*. $S_1$ represents a portion included in a portion corresponding to a distance from the side surface of the piston 20 to a portion where the O-ring 30 is in contact with the underside of the piston 20. In other words, $S_1$ represents the upper pressure receiving area. Thus, pressure is allowed to act downwardly aaainst the area $S_1$ but there is no counteracting upward force to cancel the downward $S_1$ force. As a result, the piston 20 is maintained in the first position by the pressure exerted on $S_1$. In this case, the valve open force can be arbitrarily set to be an appropriate value by adjusting the pressure acting on the head-side chamber 23.

At this stage, solenoid SOL-A can be de-energized, since the force on $S_1$ is sufficient to maintain the piston 20 in the first position. Solenoid SOL-C plays no part at this stage and is kept de-energized.

Thereafter, as shown in FIG. 3, when molten metal or other molten material is supplied to a supply hole 5*a* of an injection sleeve 5 and a plunger of an injection cylinder and the plunger head 5A is moved forward, the molten metal 7 is injected and charged in the cavity 4 via the gate 6. At this time, with SOL-A and SOL-C de-energized and with SOL-B energized, and with piston 20 in its lower position, and the valve body 22 separated from the valve seat 17*e*, the gas in the cavity 4 is discharged from the cavity and enters valve chamber 17*g* (FIG. 2) via the vent groove 10 and the bypass conduit 12, and is vented through the exhaust hole 17*f*. At this time, because of the small inertia of the gas, the valve remains in the open state although the gas flow strikes the lower end face of the valve body 22.

After the molten metal 7 is substantially charged in the cavity 4, the molten metal 7 moves upward along the vent groove 10 and abuts against the recessed portion of the lower face of the valve body 22. In this case, the force applied to the valve body 22 by the molten metal 7 pushes it up since the mass of the molten metal 7 is much larger than that of the gas and, consequently, its inertia is also large. When the upward force of the molten metal on valve body 22 is greater than the downward force on the area $S_1$, the valve body 22 will move upward. The upward movement of the valve body 22 causes a corresponding upward movement of piston 20. The upward movement of piston 20 breaks the seal between the lower face of piston 20 and an O-ring 30. Now air pressure from lower chamber 24*a* fills rod-side chamber 24*b* (the pressure is not lost to atmosphere because SOL-C is de-energized, and the switching valve 36 is closed). At this point the forces acting on piston 20 change. Since lower chamber 24*a* and rod-side chamber 24*b* are subject to equal air pressure, the downward force acting on surface area $S_1$ now has a corresponding upward force acting on the flange portion of the underside of piston 20, and the two forces cancel out. However, referring to FIG. 5, the surface area designated as $S_2$, the lower pressure receiving area of the piston 20 which corresponds to the inner diameter of the O-ring 30, comprising a concentric area of the underside of piston 20 radially extending from rod 21 to the outside wall of piston 20 (not including the flange) is exposed to an upward force which is not counteracted by a corresponding downward force. Consequently, piston 20 moves upwardly in response to the upward force on area $S_2$.

Then, piston 20 moves upward quickly by the inertial force of the molten metal 7, supplemented by the force exerted by the higher gas pressure against the underside of piston 20 in rod-side chamber 24*b*. The valve body 22 closes the bypass conduit 12, thereby shutting off the vent groove 10 and the bypass conduit 12 from the valve chamber 17*g*. Therefore, the molten metal 7 is preventing from flowing further than the closed position of valve body 22.

Because the piston 20 is forced upwardly toward the head-side chamber side of the valve to close the valve, not only by the force of the molten metal 7 but also by the force of the pressurized air, the valve is kept closed. Even if molten metal 7 is entrained by the gas and discontinuously strikes the valve body 22 in the form of splashes or droplets, the valve body 22 is pushed upward by the first wave of molten metal 7 striking the valve body 22, and the gas exhaust passage can be reliably closed merely by the force of the pneumatic pressure within the valve without the upward inertial force of the molten metal 7.

After the molten metal 7 has pressurized and cooled for a predetermined period of time following the valve body 22 closing the vent groove 10 and the bypass conduit 12, the entire degassing apparatus 16 is moved upward by the cylinder 14, as shown in FIG. 4, so that a solidified metal 33, which has filled the cavity 4, the vent groove 10, and the bypass conduit 12 may be separated from the valve body 22. When the entire degassing apparatus 16 is moved upward by the cylinder 14, the solidified metal 33 adheres to the valve body 22, pulling the valve body down to its initial open state. Thus, the valve is opened, and may be maintained in the valve open position by cotrolling the pressure in chambers 23, 24*a* and 24*b* through switching valves 34, 35 and 36. Thereafter, the movable metal mold 2 is moved to open the molds, and a molded product is then removed from the mold by the product pushing device 8.

The above valve operation is summarized as follows. In the embodiment described with reference to FIG. 2, when the valve body 22 is to be opened, air pressure is applied first to the head-side chamber 23 of piston 20, and then to central port 26*a* and lower chamber 24*a*. Meanwhile, the rod-side chamber 24*b* of piston 20 is closed to additional air pressure and ambient pressure. To maintain the valve in the open position during injection, head-side chamber 23 is opened to atmospheric pressure, and the pressure applied to lower chamber 24*a* maintains the piston in the lower position. When the valve body 22 is to be closed, the head-side chamber 23 is maintained at atmospheric pressure, and pressure from lower chamber 24*a* is applied to rod-side chamber 24*b* when the seal between piston 20 and O-ring 30 is broken by movement of the piston in response to the molten metal striking valve body 22. The greater force applied to the underside of piston 20 caused the piston to lift and the valve to close. The valve can also be closed directly by introducing air pressure to rod-side chamber 24*b* through port 27 rather than through lower chamber 24*a*.

The above described operation can be replaced with other suitable operational steps and using other switching valves or fluid pressure circuits, all of which are envisioned to be within the scope of this invention.

In the above description, opening/closing of the valve is controlled by the solenoid valve and/or collision of the molten metal against the valve body. However, of course, it is envisioned that the degassing apparatus may be operated to open and close independently of whether or when the molten metal actually impinges the valve body 22. For example, if it is known how long it takes for the molten metal to charge the mold cavity 4 and reach the vent groove 10 or bypass conduit 12, a switch located on an injection ram of the molding apparatus may be used to signal the start of the molding process and the injection of molten material into the mold.

Figure 6:
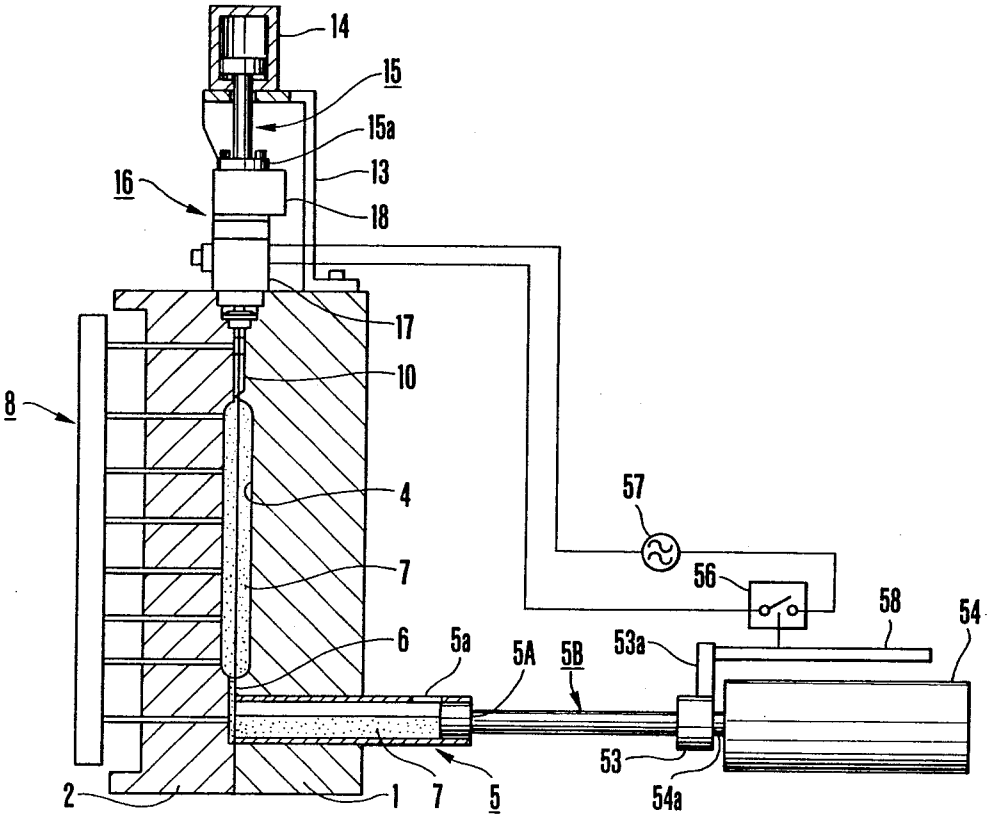
FIG. 6 is a view showing a degassing apparatus, a molding apparatus, and a diagram of a control apparatus with a limit switch according to another embodiment of the present invention.

The construction described above will be described in detail. FIG. 6 shows a control apparatus using a limit switch, the molding apparatus, and the degassing apparatus. The constructions of the molding apparatus and the degassing apparatus are the same as those in FIG. 3. The same reference numerals as in FIG. 3 denote the same parts in FIG. 6, and a detailed description thereof will be omitted. An injection sleeve 5 with a molten metal port 5*a* is engaged with the sleeve of a stationary mold 1. A molten metal 7 is supplied from the molten metal port 5*a* to the injection sleeve 5. Reference numeral 54 denotes an injection cylinder concentric with the injection sleeve 5. A plunger head 5A as a head of a plunger 5B coupled through a coupling 53 to a piston rod 54*a* reciprocally moved by an oil pressure is fitted in an inner hole of the injection sleeve 5. Reference numeral 56 denotes an electrical command unit comprising a timer and a plurality of limit switches (only one switch is illustrated) or limit switches connected between solenoids SOL-A, SOL-B, and SOL-C of switching valves 34, 35, and 36. The electrical command unit 56 opposes a striker 58 fixed to a coupling 53 through a bracket 53*a* and extending in an axial direction of the injection cylinder 54. When the electrical command unit 56 opposes predetermined positions of the striker 58, the solenoids SOL-A, SOL-B, and SOL-C are energized/deenergized at the predetermined timings.

With the above arrangement, when the molten metal 7 is supplied from the molten metal port 5*a* to cause the injection cylinder 54 to move the plunger head 5A forward, the molten metal 7 is pushed by the plunger head 5A and is injected and filled in the cavity 4. In this case, the striker 58 is moved forward upon forward movement of the plunger 5B. When the predetermined positions sequentially oppose the plurality of limit switches, the solenoids SOL-A, SOL-B, and SOL-C are sequentially energized/deenergized at the predetermined timings. Therefore, energization/deenergization of the solenoids cooperates with push-up operation of the valve body 22 by the inertia of the molten metal 7, thereby perfectly closing the valve.

When one of the limit switches is connected to the solenoid SOL-C to cause the molten metal 7 to flow through the vent groove 10 and the solenoid SOL-C is then energized, air is supplied to the rod-side chamber 24*b* to pressurize the lower surface of the flange 20*a* of the plunger 20. Even if the valve body 22 is not moved upward by the inertia of the molten metal 7, the valve 22 can be closed by only the air pressure.

A valve of the apparatus can be closed in response to an electrical signal during injection with normal molten metal flow. In this case, if the electrical signal is delayed so that it is not supplied to the valve at the proper time to close the valve, the molten metal may enter the valve apparatus before the valve closes in response to the signal, resulting in unstable operation of the degassing apparatus. However, with the embodiments of the present invention described above, since the valve can be closed by the inertia of the molten metal before the valve is closed by the delayed electrical signal during the injection process, the valve closing operation can always be reliably performed, thus assuring a safe, continuous operation over a long period of time.

The solenoids SOL-A, SOL-B, and SOL-C can be energized/deenergized in response to external signals prior to injection. When the valve body 22 is closed with an expectation operation during injection, the solenoid SOL-C of the switching valve 36 is excited during the injection.

Figure 7:
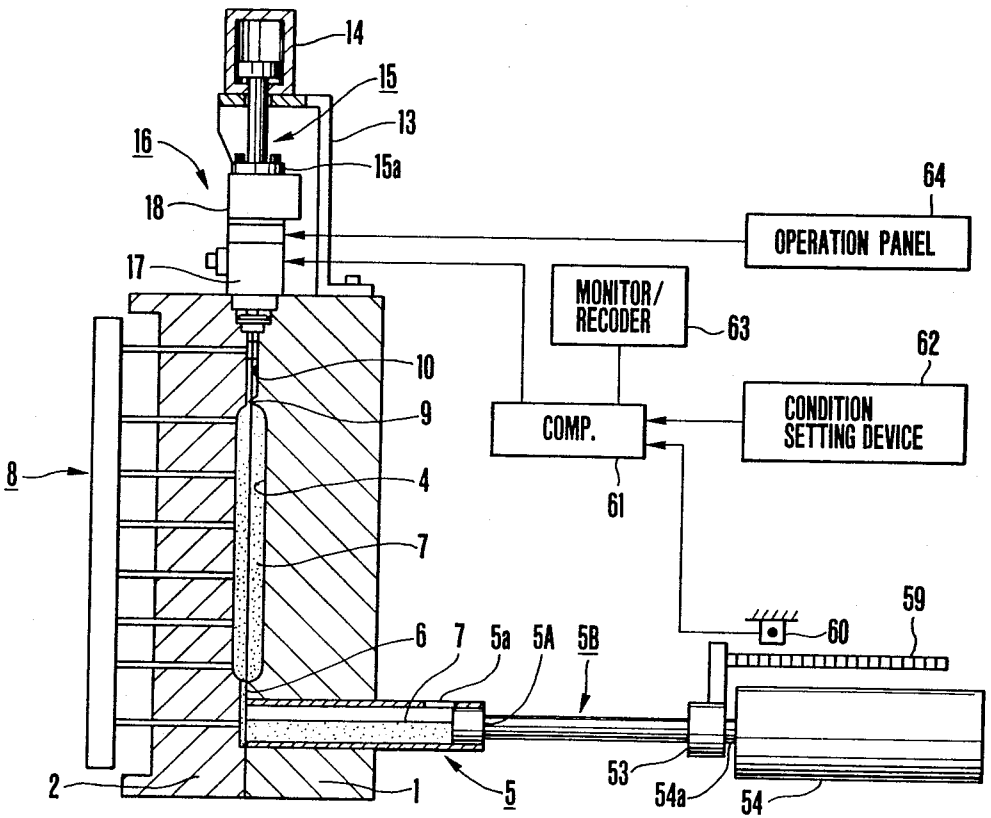
FIG. 7 is a view showing the degassing apparatus, the molding apparatus, and a control apparatus with a magnetic scale according to still another embodiment of the present invention.

FIG. 7 is a block diagram of a control apparatus using a magnetic scale. The same reference numerals as in FIG. 6 denote the same parts in FIG. 7, and a detailed description thereof will be omitted. Referring to FIG. 7, a magnetic scale 59 extends along the axial direction of an injection cylinder 54 and is fixed to a coupling 53 for coupling a piston rod 54*a* and a plunger 5B. A magnetic sensor 60 is arranged near the magnetic scale 59. When the magnetic scale 59 is moved together with the plunger 5B, a pulse signal is extracted from the magnetic sensor 60 and is supplied to a comparator 61. There is also provided a condition setting device 62 for determining the opening timings of switching valves 34, 35, and 36 which correspond to the stroke positions of the plunger 5B. The comparator 61 is electrically connected to solenoids SOL-A, SOL-B, and SOL-C. When a coincidence between both inputs is detected by the comparator 61 or a predetermined period of time is counted by the timer, a signal is output from the comparator 61. Therefore, the solenoids are energized/-deenergized at the predetermined timings. In particular, the solenoid SOL-C is energized by a valve closing command from the magnetic sensor 60 to close the valve body 22. Reference numeral 63 denotes a monitor or a recorder; and 64, an operation panel for manually opening/closing the switching valves 34, 35, and 36.

With the above arrangement, when a molten metal 7 is injected and filled and the plunger 5B is moved forward, the magnetic scale 59 integral with the plunger 5B is moved forward. The pulse signal is extracted from the magnetic sensor 60 and is input to the comparator 61. A preset signal is also input from the condition setting device 62 to the comparator 61. When these input signals coincide with each other, a signal is output from the comparator 61. The solenoid SOL-C is energized/-deenergized at the predetermined timings. The operation of the solenoid cooperates with upward movement of a valve body 22 by means of the inertia of the molten metal 7. Alternatively, the valve body 22 can be satisfactorily closed in response to only a valve closing command signal.

In this case, if energization of the solenoid SOL-C upon passing of the molten metal 7 through a vent groove 10 is set in the condition setting device 62, air is supplied into the rod-side chamber **24*b* to pressurize the lower surface of a flange 20*a*. Even if the valve body 22 is not moved upward by the inertia of the molten metal 7, the valve body 22** can be completely closed by only the air pressure.

When the valve body 22 is to be closed using an electrical valve closing command signal during injection, the signal generation timing must be properly set to sufficiently remove the gas from a cavity 4 while the molten metal should not be supplied to a degassing apparatus 16.

In order to close the valve body 22 without moving the valve body 22 upward by the inertia of the molten metal 7, a detecting means may be arranged at the inlet port of the vent groove 10 serving as the molten metal path to detect passing of the molten metal. In this case, the solenoid valve SOL-C is energized in response to a detection signal from the detecting means to close the valve body 22. FIGS. 8 to 12 show detailed arrangements as the detecting means for closing the valve body.

Figure 8:
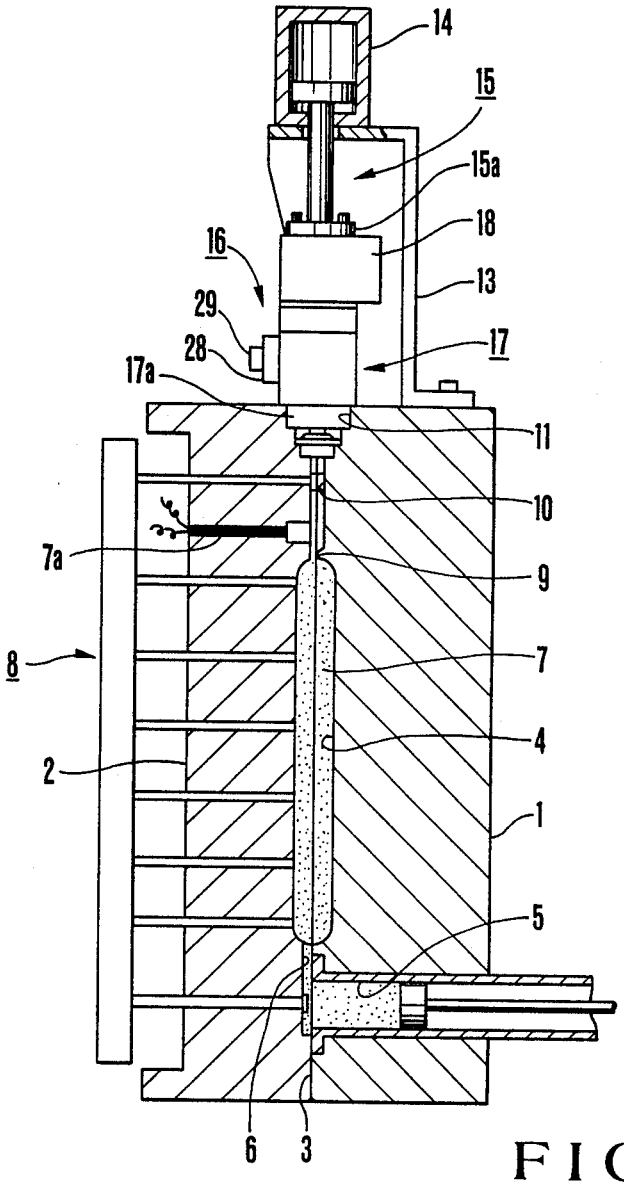
FIG. 8 is a view showing a degassing apparatus employing a molten metal detector according to still another embodiment of the present invention.

The same reference numerals as in the previous embodiments denote the same parts in FIG. 8.

FIG. 8 shows an arrangement in which a temperature sensor **7*a* is arranged near the inlet port of a vent groove 10 continuous with a vent path 9 of a movable mold 2. When the sensor 70 detects a molten metal flow, the valve is closed. For example, a signal from the switch or from the temperature sensor may be provided an electronic control circuit. In turn, the electronic control circuit may supply a control signal to solenoid SOL-C at switching valve 36**, for example.

Figure 9:
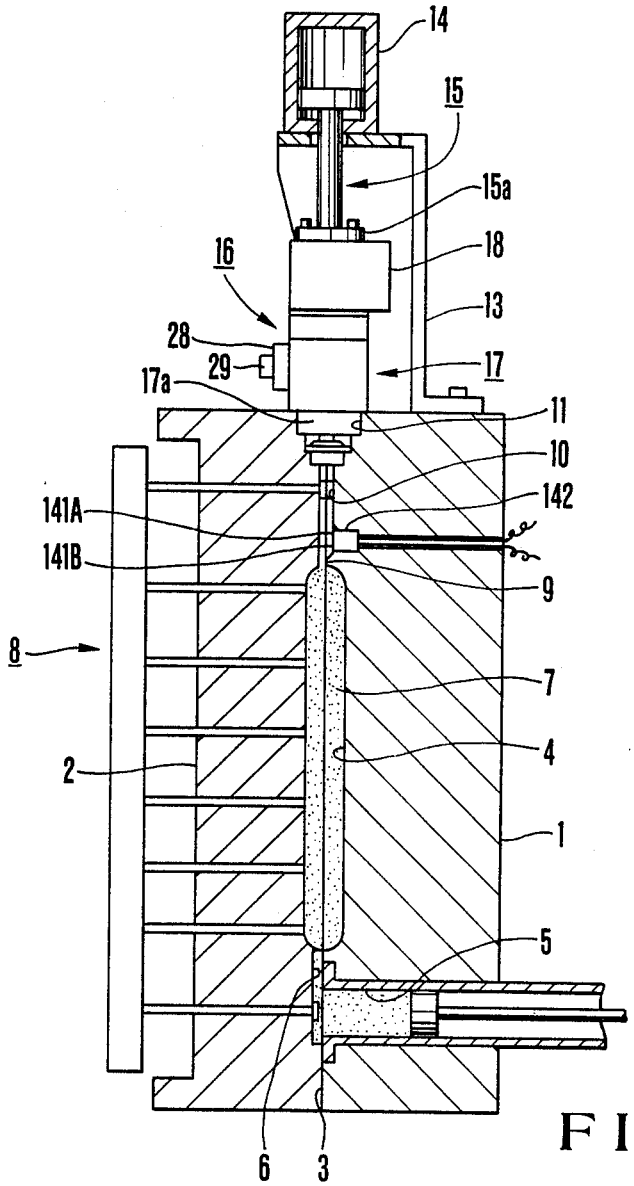
FIG. 9 is a view showing a degassing apparatus employing a molten metal detector according to still another embodiment of the present invention.

FIG. 9 shows another detecting means. A small space is formed between a pair of electrodes 141A and 141B opposite to a vent groove 10 continuous with a vent path 9 of a stationary mold 1. The pair of electrodes 141A and 141B are covered with a heat-resistive insulating material 142 such as a ceramic material. The electrodes 141A and 141B are electrically connected to a solenoid SOL-C. When a molten metal 7 filled in a cavity 4 and passes through the vent groove 10, the electrodes 141A and 141B detect the molten metal flow, and the solenoid SOL-C is energized to close a valve body 22.

With the above arrangement, when the molten metal 7 is filled and passes through the vent groove 10, the electrodes 141A and 141B are electrically connected to energize the solenoid SOL-C. As shown in FIG. 2, air in the lower chamber **24*b* is supplied to the rod-side chamber 24*b* through a space between the flange of a piston 20 and an O-ring 30. The piston 20** is abruptly moved upward to close the valve. In order to close the valve, the electrical means can be used together with the pneumatic means or can be used independently of the mechanical means to satisfactorily close the valve.

Figure 12:
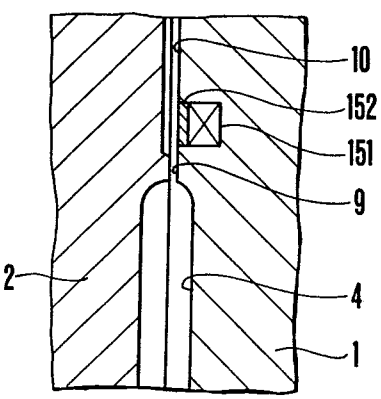
FIGS. 10 to 12 are views showing degassing apparatus employing molten metal detectors according to other embodiments of the present invention.
Figure 11:
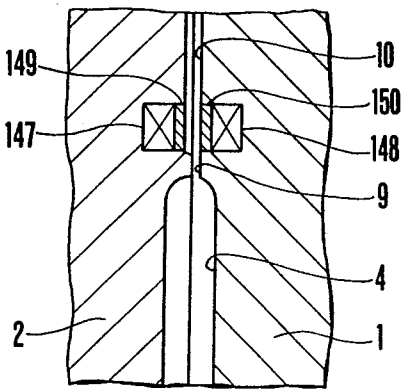
Figure 10:
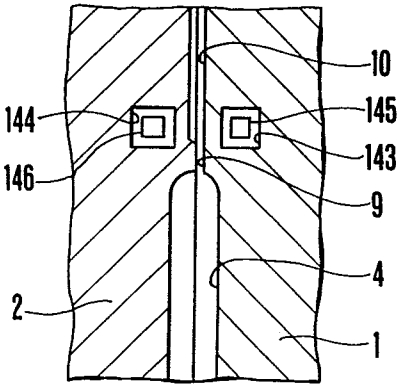

FIGS. 10 to 12 show molten metal detectors according to other embodiments of the present invention. In an arrangement shown in FIG. 10, spaces 143 and 144 are formed in a stationary mold 1 and a movable mold 2 so as to interpose an inlet port of a vent groove 10 continuous with a vent path 9. An ultrasonic transmitter 145 and an ultrasonic receiver 146 are arranged in the spaces 143 and 144, respectively. With this arrangement, when a molten metal 7 is supplied to the vent groove 10, an ultrasonic wave emitted from the ultrasonic transmitter 145 is attenuated by the molten metal 7 and the attenuated wave is received by the ultrasonic receiver 146, thereby detecting the molten metal 7 and hence closing a valve body 22. The operations after detection are the same as those described above, and a detailed description thereof will be omitted.

In an arrangement shown in FIG. 11, primary and secondary coils 147 and 148 are respectively arranged in stationary and movable molds 1 and 2 so as to interpose the inlet port of a vent groove 10 therebetween. Heat-insulating members 149 and 150 are respectively mounted on the side surfaces of the coils 147 and 148 which oppose the vent groove 10. The heat-insulating members 149 and 150 are made of a nonmagnetic material such as a ceramic material. With this arrangement, the magnetic flux does not act on the molds 1 and 2. When a molten metal 7 is guided to the vent groove 10, the magnetic flux is shielded by the molten metal 7, and a voltage induced by the secondary coil 148 is changed, thereby detecting the flow of the molten metal 7 and hence closing a valve body 22.

In an arrangement of FIG. 12, a sensor coil 151 is mounted on a stationary mold 1 so as to face the inlet port of a vent groove 10 while the sensor coil 151 is protected with a heat-insulating member 152 made of a nonmagnetic material. An RF current is supplied to the sensor coil 151. With this arrangement, when a molten metal 7 is supplied to the vent groove 10 and shields the magnetic flux, an eddy current is generated on the surface of the molten metal 7 so as to cancel the magnetic flux. The impedance of the sensor coil 151 is changed to detect the flow of the molten metal 7, thereby closing a valve body 22.

In the above embodiments, an exhaust hole or outlet port opening **17*f* formed in a spool 17 is exposed to atmospheric air. However, the exhaust hole 17*f* may be coupled to a vacuum suction device, the cavity 4 may be evacuated, and the valve body 22 may be closed. This arrangement is shown in FIG. 13**.

Figure 13:
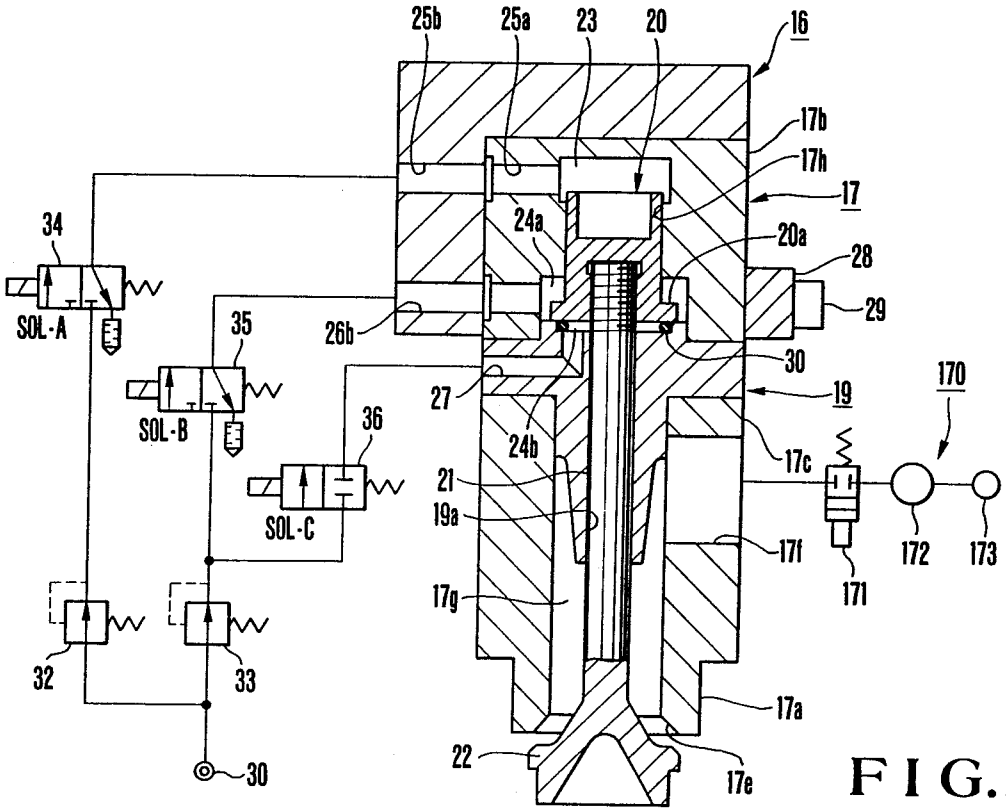
FIG. 13 is a view of a degassing apparatus and a pneumatic circuit diagram of a pneumatic control circuit adapted for use with the degassing apparatus according to still another embodiment of the present invention.

The same reference numerals as in FIGS. 1 to 5 denote the same parts in FIG. 13.

Referring to FIG. 13, a vacuum suction device 170 is connected to the exhaust hole 17*f* to evacuate a valve chamber 17*g* at a predetermined timing. The vacuum suction device 170 includes a switching valve 171, a vacuum tank 172, and a vacuum pump 173.

With the above arrangement, when a solenoid valve SOL-A is energized and solenoids SOL-B and SOL-C are deenergized, a fluid is supplied from pòrts 25*b* and 25*a* to a head-side chamber 23 to move a piston 20 downward. A valve body 22 is separated from a valve seat 17*e*. In this state, when the solenoid valve SOL-B is energized, the lower surface of the piston 20 is urged against an O-ring 30, as shown in FIGS. 2 and 5, thereby maintaining the valve open state. In this case, the valve open force is maximum. When the solenoid SOL-A is deenergized before a molten metal 7 reaches the valve body 22, the head-side chamber 23 is set at the atmospheric pressure. The fluid from the rod-side chamber 24*b* leaks through a gap between a valve rod 21 and an inner hole 19*a* of a valve guide 19 and is held at the atmospheric pressure. The valve open force can be arbitrarily set by causing a reducing valve or regulator 32 to adjust the pressure of the head-side chamber 23.

As shown in FIG. 5, an upper pressure receiving area $S_1$ of a flange 20*a* is smaller than a lower pressure receiving area $S_2$. The following operation can be performed accordingly. In the valve open state, the piston 20 is urged against the O-ring 30 by a force represented by $S_1 \times$(fluid pressure). When the valve body 22 is slightly moved upward in the valve closing state by an external force and is slightly separated from the O-ring 30, the fluid is supplied through this gap into the rod-side chamber 24*b*. The force represented by $S_2 \times$(fluid pressure) is also applied to the lower portion of the piston 20. Since $S_2 > S_1$ is established, the piston 20 is abruptly moved upward. Therefore, the valve seat 17*e* is abruptly closed, and the valve closing state is set.

At the start of valve opening/closing, the head-side chamber 23 is pressurized, and the initial valve open force is larger than a valve closing force acting on the valve body 22 by means of the vacuum suction device 170 operated at the start of vacuum suction from the valve unit during injection. In this state, the valve body 22 is not closed even at the start of vacuum suction. Thereafter, the cavity 4 is set in a vacuum state. Even if the head-side chamber 23 is set at the atmospheric pressure, the valve open force acts on the valve. The valve open force becomes smaller than the initial valve open force, the valve is immediately closed with a small valve closing force.

The operation will be described in detail with reference to FIG. 6. After the molds 1 and 2 are clamped, a fluid pressure cylinder 14 is operated to move the degassing apparatus downward. A stepped portion 17*a* of a spool 17, as shown in FIG. 1, is fitted in a spool hole 11. When a molten metal 7 is supplied from a molten metal port 5*a* to cause an injection cylinder 54 to move a plunger head 5A forward, the molten metal 7 is pushed by the plunger head 5A and is injected and filled in the cavity 4. In this case, a striker 58 is moved forward together with the plunger 5B. The following operations are performed by sequentially facing a plurality of limit switches of a command unit 56 and the predetermined positions of the striker 58 and by operating the timer. First of all, injection is started to energize a solenoid SOL-A and deenergize solenoids SOL-B and SOL-C s that the piston 20 is moved downward. Subsequently, the solenoid SOL-B is energized to urge the lower surface of the piston 20 against the O-ring 30. In this case, the valve body 22 and the valve seat 17*e* are kept in the open state shown in FIGS. 1 and 2. The lower surface of the valve body 22 closes the upper opening of a vent groove 10, and the vent groove 10 communicates with a spool valve chamber 17*g* through a bypass conduit 12 and a valve opening portion. In this state, forward movement of the plunger 5B is started, the operation of the vacuum suction device 170 is initiated, and the timer in the command unit 56 is started. Upon operation of the vacuum suction device 170, the gas in the cavity collides with the lower end of the valve body 22 through the vent groove 10 and is drawn by the vacuum suction device 170 from an exhaust hole 17*f* through the bypass conduit 12 and the valve chamber 17*g*.

Figure 14:
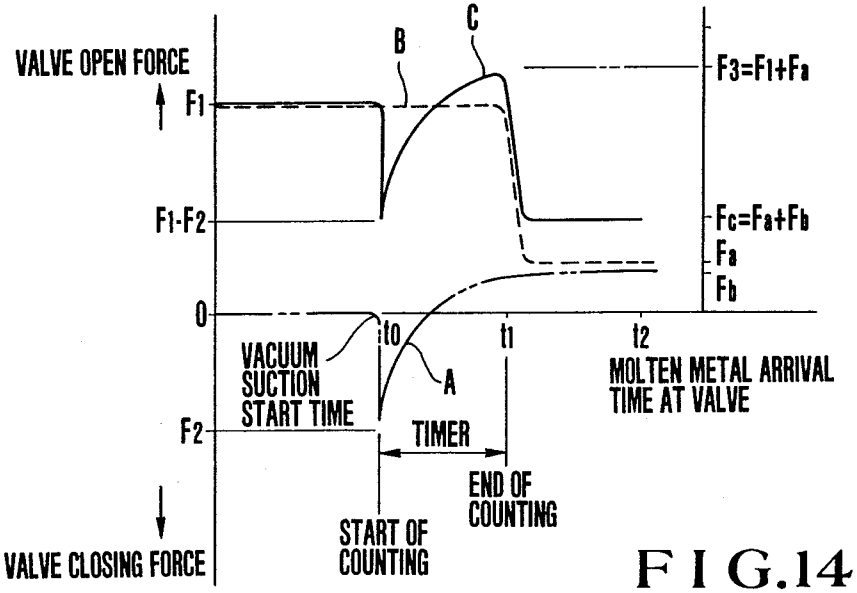
FIG. 14 is a graph showing changes in force acting on the valve as a function of time.

FIG. 14 is a graph showing changes in force acting on the valve or a control state as a function of time. At time t0 when vacuum suction is initiated, the gas in the cavity 4 and the vent groove 10 is abruptly drawn from the bypass conduit 12 through a gap between the valve body 22 and the valve seat 17*e* in the valve opening direction. Therefore, a valve closing force $F_2$ acts on the valve body 22. In this case, since a valve opening force $F_1$ larger than the valve closing force $F_2$ acts on the head- and lower chambers 23 and 24*a* of the piston 20 by hydraulic action, a force $(F_1 - F_2) > 0$ acts on the valve body 22 and the valve can be sufficiently kept open.

As shown in FIG. 14, the relative large valve closing force $F_2$ acts on the valve body 22 at vacuum suction start time t0. The cavity 4 and the vent groove 10 are abruptly evacuated, and the gas flow by vacuum suction from the bypass conduit 12 to the gap between the valve body 22 and the valve seat 17*e* is not longer present. When the vacuum state is set, a valve opening force Fa acts on the valve body 22 due to a difference between the fluid pressure (even if this pressure is zero atmosphere) of the piston 20 and a negative pressure in the vent groove 10.

The timer is started from the vacuum suction start time t0 and is stopped at time t1. A duration of time t0 and time t1 is given as a few fractions of one second or a few seconds. The fluid pressure of the head-side chamber 23 is set to be zero atmosphere by setting the fluid pressure of the head-side chamber 23 at the atmospheric pressure. In this case, the fluid pressure acting on the valve body 22 is only the fluid pressure acting on the lower chamber 24*a*. The force Fb acts on the valve body 22, and finally a force Fc (=Fa+Fb) acts on the valve body 22.

If the valve opening force generated by the fluid pressure acting on the head-side chamber 23 is kept applied to the valve body 22, a relatively large force $F_3$ $(=F_1+Fa)$ acts on the valve body 22. In this case, the valve body 22 cannot be closed unless the corresponding large inertia of the molten metal acts thereon. In this embodiment, when the inertia of the molten metal acts on the valve body 22, the force Fc (=Fa+Fb) acting on the valve body 22 is set to be relatively small. Therefore the valve body 22 can be immediately closed by the corresponding small inertia.

Time t2 in FIG. 14 indicates a molten metal arrival time. The alternate long and two short dashed line A represents a force acting on the valve by vacuum suction. A dotted line B represents a valve open force, i.e., the force acting on the valve in the valve opening direction. A solid line C represents a force actually acting on the valve.

When the piston 20 is held in the lower limit, the solenoid SOL-A is deenergized to set the head-side chamber 23 at the atmospheric pressure. When the molten metal 7 reaches the valve body 22 and the valve body 22 is slightly moved upward from the O-ring 30 by the inertia of the molten metal 7. The fluid is flowed into this gap. Since the upper and lower pressure receiving areas of the flange 20*a* of the piston 20 satisfy condition $S_2 > S_1$, and the piston 20 is abruptly moved upward to immediately close the valve seat 17*e*, and the valve closed state is maintained. At the time of valve closing, the head-side chamber 23 is set at the atmospheric pressure during injection, upward movement of the piston for opening the valve can be smoothly performed, and the valve open state can be assured.

Figure 15A:
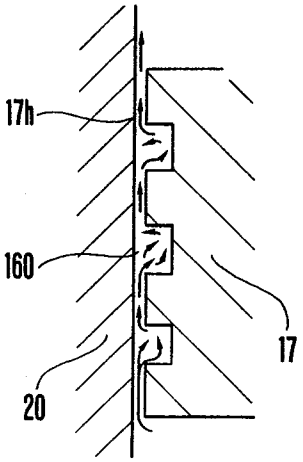
FIGS. 15 and 15*a* are sectional views showing a degassing apparatus according to still another embodiment of the present invention.
Figure 15:
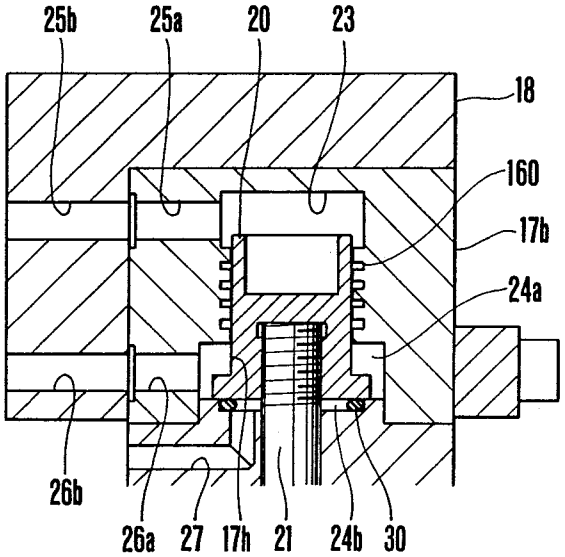
Figure 16:
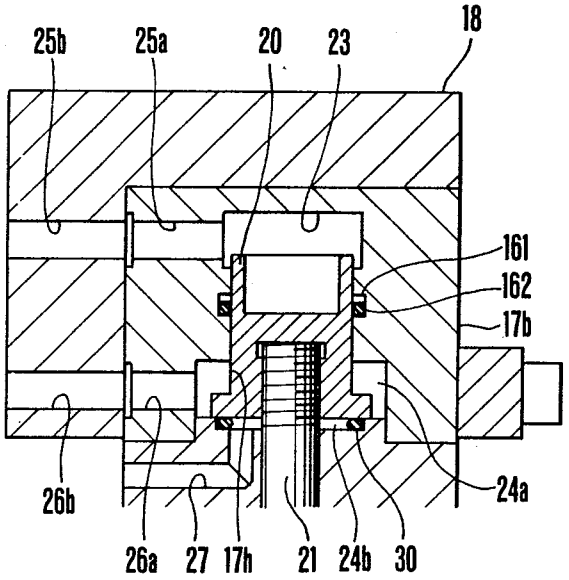
FIG. 16 is a sectional view showing a degassing apparatus according to still another embodiment of the present invention.

Referrin9 to FIGS. 15, 15*a* and 16 there are shown to longitudinal sectional views of the degassing apparatus in the region of piston 20. As can be seen from a comparison of these figures and FIGS. 2 to 5, the embodiment described previously is similar in many respects to the embodiments which will now be described. The same reference numerals as in FIGS. 2 to 5 denote the same parts in FIGS. 15, 15*a* and 16 and a detailed description of such similar parts will be omitted.

These figures (15, 15*a* and 16 show two methods of reducing the loss of air pressure that can occur at the boundary between cylinder wall 17*h* and the perimeter of piston 20. Because it is important that piston 20 slide freely along a longitudinal axis, a small gap must be provided. On the other hand, the gap cannot be too large because critical pressure loss may occur at either head-side chamber 23 or lower chamber 24*a*. The problem is further complicated by the possibility of uneven expansion and contraction of the piston and spool 17 due to temperature differentials encountered during the injection process.

One solution, incorporating the labyrinth seal effect is shown in FIGS. 15 and 15*a*. Here, a series of channels 160, rectangular in cross-section, have been made at spaced apart intervals along cylinder wall 17*h*. When escaping air travels along the gap between piston 20 and the cylinder wall it will be swirled into and about the channels creating turbulence and providing for expansion of the air. The turbulence will act to resist the flow of air along the gap and the room for expansion of the air will decrease the force of the escaping air. This technique has an advantage in that additional friction is not placed on the piston—cylinder wall interface.

Another solution to the escaping air problem is found in FIG. 16. Here, a channel 161 is provided in the cylinder wall 17*h*. Within this channel 161 is placed an O-ring 162 having an internal diameter slightly smaller than the outside diameter of piston 20. The O-ring 162 creates an effective seal preventing the leakage of air along the piston—cylinder wall interface.

As may be readily discerned from the discussion above, the seal separating lower chamber 24*a* and rod-side chamber 24*b* is important to the efficient and smooth operation of the present invention. The preferred embodiment discussed above, calls for an O-ring 30 to be placed inside stepped portion 19*g* of valve guide 19. There are several other methods of providing a seal between piston 20 and valve guide 19 to separate lower chamber 24*a* and rod-side chamber 24*b*.

Referring to FIGS. 17 to 20, there are shown longitudinal sectional views of four alternative embodiments of the degassing apparatus of the present invention.

Figure 17:
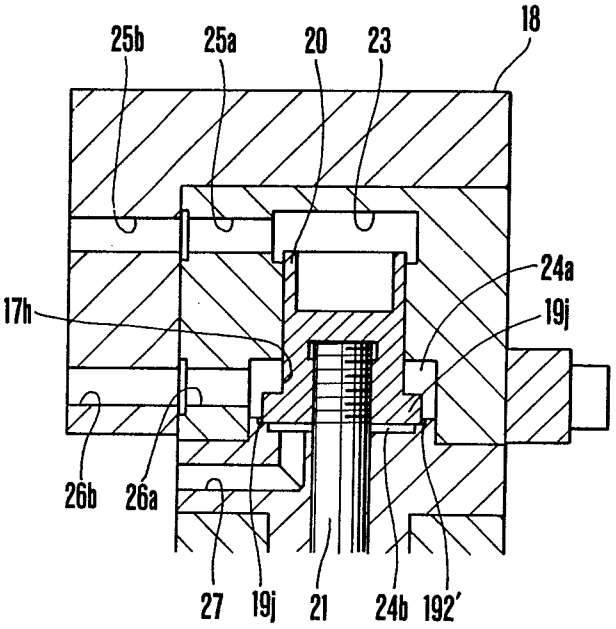
FIGS. 17 to 20 are sectional views of degassing apparatuses according to other embodiments of the present invention, respectively.

FIG. 17 shows an embodiment which eliminates the need for an O-ring. The stepped portion 19*g* of valve guide 19 is provided with an inside diameter slightly larger than the outside diameter of piston 20. Thus, the underside of piston 20 forms a seal with the upper side 19*i* of valve guide 19. This solution allows a slight gap G between the sidewall 20*s* of piston 20 and the internal sidewall 19*j* of valve guide 19 to reduce friction. However, the seal at the upper side 19*i* of the valve guide 19 will prevent escaping air. This solution eliminates the need for an O-ring, which may have a short lifespan in the environment of the degassing apparatus.

Figure 18:
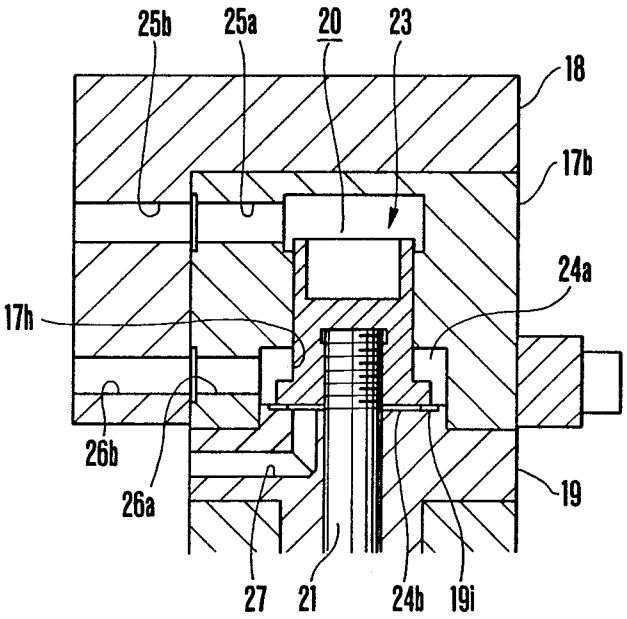

Another alternative embodiment is shown in FIG. 18. Here the configuration of stepped portion 19*g* of valve guide 19 is substantially the same as in the preferred embodiment. Instead of an circular cross-sectional O-ring, a flat copper ring 19L is provided. The flat copper ring is capable of withstanding the higher stresses found in the degassing apparatus. Other materials capable of withstanding the stresses found, can be used also.

Figure 19:
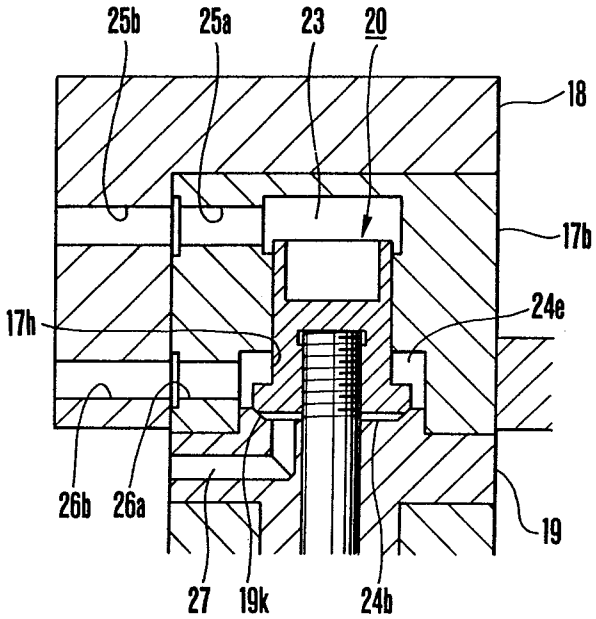

An additional embodiment is shown in FIG. 19. In this embodiment, a variation of the embodiment of FIG. 17 is shown. Here, the sidewall 19*k* of valve guide 19 is chamfered. The juncture of the underside 204 and sidewall 205 of piston 20 is also chamfered to mesh with the chamfered surface of sidewall 19*k*. This arrangement provides a tight seal along the chamfered surfaces.

Figure 20:
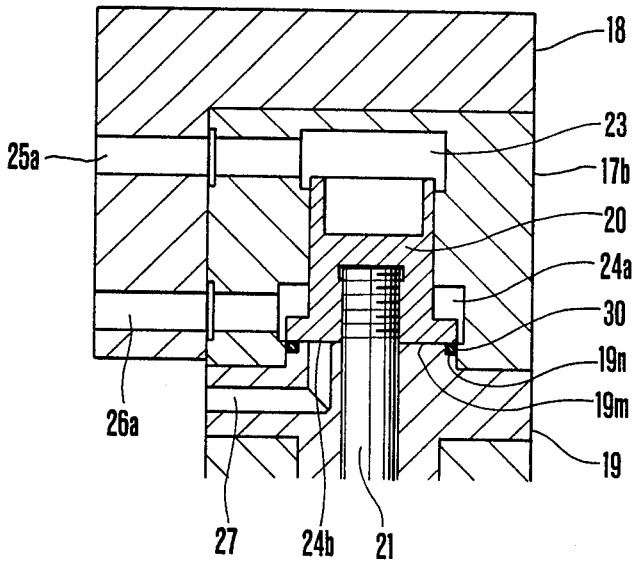

FIG. 20 shows an arrangement wherein the inside stepped portion 19*g* of the valve guide 19 is omitted and an annular groove 19*n* is formed in a peripheral portion of the surface 19*m* opposite to an underside 20*m* of the piston 20. In this case, the rod side chamber 24*b* is formed in a portion facing the underside of the piston 20 of the lower port 27 or the fluid pressure receiving surface 20*m* of the underside of the piston 20.

Figure 21:
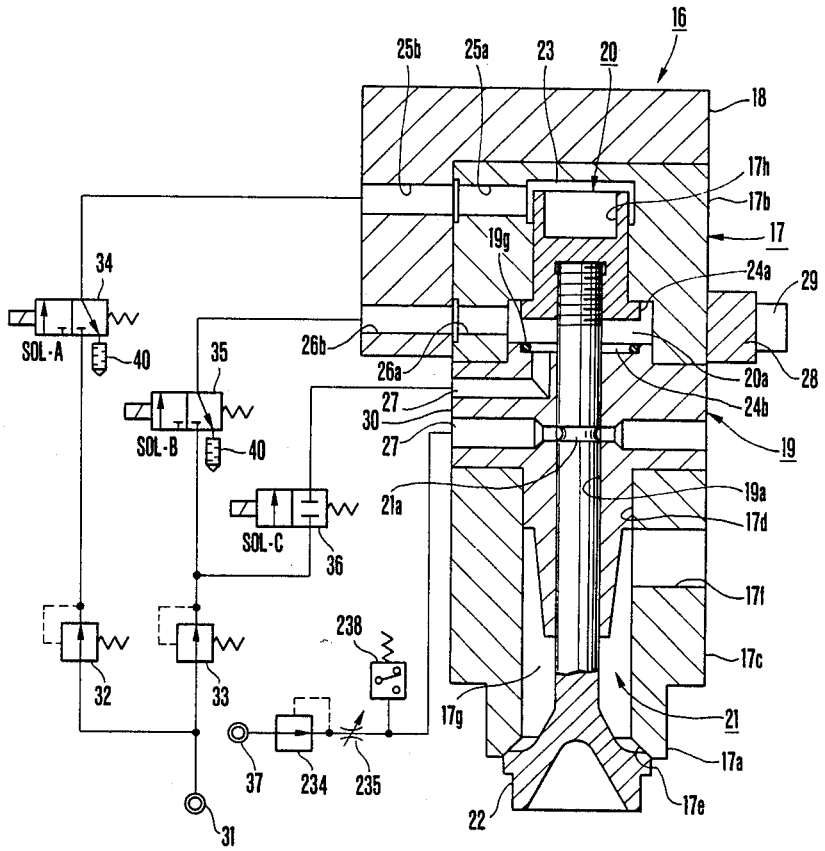
FIGS. 21 and 22 are views showing a modification of the present invention in which a degassing apparatus is used for a metal mold of a die-cast machine.
Figure 22:
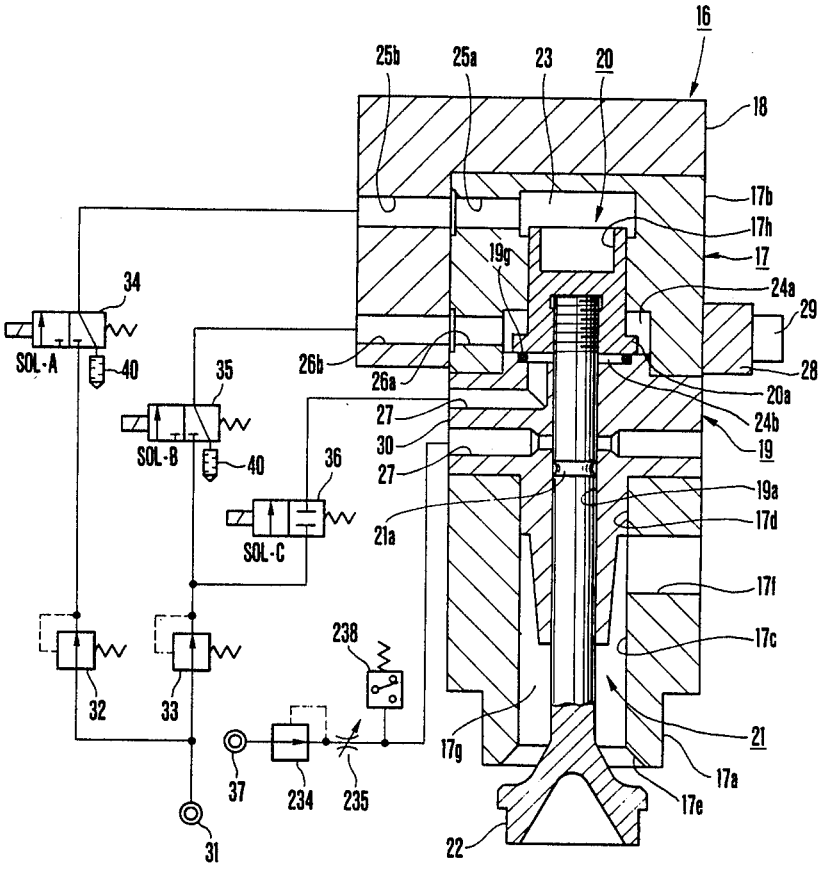

FIGS. 21 and 22 show a modification of the present invention in which a degassing apparatus is used for a metal mold of a die-cast machine. The same reference numerals in FIGS. 21 and 22 denote the same parts having the same functions as in the embodiment shown in FIGS. 1 to 5. The difference between the modification shown in FIGS. 21 and 22 and the previous embodiment is that a through hole 19*b* is formed in the valve guide 19 extending in its radial direction, and an annular groove 21*a* is formed in the upper outer peripheral surface of the valve rod 21.

More specifically, the through hole 19*b* is formed with a small-diameter portion adjacent to the valve rod 21. The position of the annular groove 21*a* is determined such that, when the valve rod 21 is at its upper position in the valve closed state, the annular groove 21*a* is aligned with the small diameter portion of the through hole 19*b* to communicate therewith to define a fluid path through the valve, and when the valve rod 21 is in its lower position in the valve open state, the annular groove 21*a* is shifted from the through hole 19*b* in the axial direction so as not to communicate therewith.

One end of the through hole 19*b* is air-tightly connected to a pipe or conduit 236 including a reducing valve or regulator 234 and a variable throttle valve 235. The pipe 236 is connected to an air source 237. With this arrangement, when the valve rod 21 moves downward and the annular groove 21*a* is shut off from the through hole 19*b* while air is being supplied from an air source 29, since the through hole 19*b* is closed by the valve rod 21, the pressures in the pipe 236 and in the through hole 19*b* at the left of FIG. 21 are increased. When the valve rod 21 moves upward and the annular groove 21*a* communicates with the through hole 19*b*, since the through hole 19*b* at the right of FIG. 21 is open to atmospheric pressure, the pressure in the pipe 236 is reduced. A pressure switch 238 is coupled to the pipe 236 and used as a detector for detecting a change in the pressure in pipe 236 to turn an electrical circuit on and off. The electrical circuit may include an indicator such as a pilot lamp or a buzzer so that the valve open/close operation can be signaled to an operator.

Since this pressure detector detects the valve open/-close operation and signals the operator, the valve open state can be confirmed before molten metal is injected into the die-casting machine. Since degassing in the metal molds can be reliably performed, an injection product without voids or air bubbles can always be obtained, thus greatly improving the quality of the molded product. Since the pressure detector can be situated on the die-casting machine away from high-temperature components, erroneous operation or trouble caused by heat can be minimized, thus improving reliability and durability.

During the injection operation of the degassing apparatus with the above arrangement, air from the variable throttle valve 235, the pressure of which is adjusted, is supplied to the through hole 19*b* from the air source 237. When the valve rod 21 moves downward, as shown in FIG. 21, and degassing is performed while the valve body 22 is open, since the annular groove 21*a* of the valve rod 21 moves downward and the valve rod 21 closes the through hole 19*b*, the pressure in the pipe 236 and the through hole 19*b* at the left side of FIG. 21 is increased. As shown in FIG. 22, when the valve rod 21 moves upward under the influence of the molten metal 7, the through hole 19*b* communicates with the annular groove 21*a*, and pressurized air from the air source 237 is open to the atmosphere through the through hole 19*b* at the right side of FIG. 22, thus reducing the pressure in pipe 236. Since the pressure switch 238 is open and closed by an increase or decrease in the air pressure in pipe 236, the open and closed status of the valve body 22 may be confirmed if the circuit of the pressure switch 238 includes a pilot lamp or a buzzer. In this case, since the pressure switch 238 used as a detector is separated from the high-temperature cylinder 17, its temperature will not be increased. Since the valve open state of the valve body 22 can be confirmed before molten metal 7 is injected into the molding apparatus, the metal mold can be reliably degassed.

In the modification shown in FIGS. 21 and 22, the through hole 19*b* does not communicate with the annular groove 21*a* when the valve is in the valve open state, but they do communicate with each other in the valve closed state. However, when the annular groove 21*a* is formed in an upper portion, through hole 19*b* and groove 21*a* can communicate with each other in the valve open state and vice versa. Alternatively, a through hole extending through the valve rod 21 in its radial direction can be formed in place of the annular groove 21*a*. Furthermore, if a solenoid valve is provided to a detector, e.g., pressure switch 238, so that air flows only when the valve open and closed states are confirmed, pressurized air may be saved. In this modification, the present invention has been exemplified with reference to the metal mold of a die-cast machine, but can be similarly applied to the metal mold of an injection molding machine.

In the present invention, when the valve body 22 moves to the valve open position, the valve may be maintained in the open state. After the valve body 22 is moved to the valve closed position due to the force of the molten metal impinging the valve body during the injection molding process, or by an electrical signal generated during the injection molding process, the air pressure in the head-side chamber of the piston is automatically relieved, so that the valve body may be maintained in the valve closed state.

Compressed air is normally used as the fluid for holding the valve open or closed. When a working oil is used as the fluid, a hydraulic pressure pump must be used as a fluid supply source, and the exhaust ports of the respective switching valves must be connected to an oil tank through conduits or pipes. In the above embodiments, the present invention has been exemplified with reference to the metal molds of the die-cast machine, but can be similarly applied to the molds of an injection molding machine.

As is apparent from the above descriptions of illustrative embodiments of the present invention, the degassing apparatus for metal molds includes a flanged piston fitted in an inner bore or hole of a spool, which flanged piston is fixed to an end portion of a valve rod at a side opposite to a valve body. Three ports are provided which respectively open to a rod-side chamber, a lower chamber and a head-side chamber. The rod-side chamber and the lower chamber are separated by a seal made between the piston and a valve guide when the flanged piston is in a lower position. These ports, and a pressurized fluid source, are connected through pipes or conduits having switching valves. When the valve body is in the valve open state during degassing, the valve open state is maintained by air pressure on the upper flanged surface of the piston. During the injection molding process, after the molten metal impinges the valve body to close the valve, the pressure in the lower chamber is equilibrated with the pressure in the rod-side chamber. Since the rod-side of the piston has a larger, horizontal effective surface area than the lower chamber side of the piston, the effect is that the piston is raised and the closed state of the valve is maintained the valve in the closed state.

Therefore, unlike a conventional degassing apparatus using a leaf spring, ball and detent to hold the valve in a particular state, there are no similar mechanical parts which can wear over extended periods of use, and the holding force at the open and closed positions can be reliably maintained over a long period of time, thus considerably improving the mechanical strength and reliability of the apparatus. Since the valve can always be satisfactorily operated and gas exhaustion during injection can be reliably performed, a good injection product having a high mechanical strength without void area caused by entrained gas can be easily obtained. The number of components used in the degassing apparatus is significantly reduced from that of conventional degassing apparatuses, which allows for easy maintenance. In addition, the holding force at the valve open position can be easily adjusted by changing the reducing valve or regulator. Furthermore, the present arrangement allows for a quicker equilibration of pressure than that available where small pressure equalizing holes are made in the piston. The present arrangement also allows for a stronger piston because it is not necessary to provide ports in the piston, such ports being detrimental to the strength and useful life of the piston. In addition, the present invention requires a very simple switching valve arrangement, requiring less than three solenoids and valves. Other arrangements require more complicated switching configurations, and are therefore more prone to breakdowns than the present invention.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

As shown in FIG. 2, the flange 20*a* is formed on the piston. However, the flange need not be formed on the piston. In this case, the piston has a cylindrical shape, and other constructions thereof are not changed. When the upper surface of the rod-side chamber 24*b* is closed by the surface of the piston 20 on the side of the valve body 22 in a valve open state, the valve open force is applied from the port 25*b* to the piston 20. When the surface of the piston 20 on the side of the valve body 22 is slightly separated from the upper surface of the rod-side chamber 24*b* at the start time of valve closing, the valve closing force larger than the valve open force is applied from the third port 27 to the lower surface of the piston 20. In this case, as another embodiment a small pressure may be applied through the port 25*b*, and a force larger than the pressure acting on the head-side chamber 23 may be applied to the lower chamber 24*a*.

What is claimed is:

1. A degassing apparatus incorporated with a molding apparatus having a mold cavity, which comprises:

a spool having a bore formed therein, the spool further having formed therein a gas inlet opening adapted to be communicatively coupled to the mold cavity of the molding apparatus, and a gas outlet opening, the gas inlet and outlet openings being in selective communication and non-communication with each other;

means for selectively controlling the communication and non-communication between the gas inlet and gas outlet openings; and a piston mounted in the bore and coupled to the communication controlling means, the piston being reciprocatingly slidable between a first position and a second position, the bore being further formed with a head-side chamber and a rod-side chamber situated on opposite axial sides of the piston, and a lower chamber radially surrounding a portion of said piston;

the spool further including first, second and third fluid ports formed therein, said ports being in communication with the head-side, rod-side and lower chambers respectively, said lower chamber being in communication with said rod-side chamber when said piston is in the second position, wherein the gas inlet and outlet openings are in non-communication, and said lower chamber being in non-communication with said rod-side chamber when said piston is in the first position, wherein the gas inlet and outlet openings are in communication.

2. A degassing apparatusas defined by claim 1, wherein said lower chamber is maintained in non-communication with said rod-side chamber when said piston is in said first positio by a seal created by the underside of said piston contacting an upper surface of said rod-side chamber.

3. A degassing apparatusas defined by claim 2, wherein said seal includes an O-ring seated at the upper surface of said rod-side chamber.

4. A degassing apparatus as defined by claim 2, wherein said seal includes a cooper gasket seated at the upper surface of said rod-side chamber.

5. A degassing apparatus as defined by claim 1, wherein said bore includes sealing means for providing a seal between the wall of said bore and said flanged piston mounted in the bore.

6. A degassing apparatusas defined by claim 5, wherein said sealing means includes a plurality of circumferential channels provided in the wall of said bore.

7. A degassing apparatus as defined by claim 5, wherein said bore includes a circumferential channel provided in the wall of said bore and said sealing means includes an O-ring positioned within said channel.

8. A degassing apparatus s defined by claim 1, wherein the first, second and third ports are adapted to receive a pressurized gas, and wherein said rod-side chamber has an effective surface area which is greater than the effective surface area of the lower chamber to move the piston into, and maintain the piston in, the first position when equal gas pressures are supplied to the rod-side and lower ports.

9. A degassing apparatus s defined by claim 1, wherein the means for selectively controlling the communication and non-communication between the gas inlet and gas outlet openings includes a valve body mounted on the piston and reciprocatingly slidable within the spool bore, and a valve seat defined by the spool and situated at the gas inlet opening, the valve body being adapted to closely engage the valve seat to form a gas tight seal therewith.

10. A degassing apparatus as defined by claim 9, further comprising: means for detecting a molten metal flow, said molten metal flow detecting means being arranged in a molten metal flow path between said mold cavity and said valve body; and a fluid pressure device, connected to said detecting means, for closing said valve on the basis of an output from said detecting means.

11. A degassing apparatus as defined by claim 10, wherein said detecting means comprises a sensor for detecting a temperature of the molten metal flow.

12. A degassing apparatus as defined by claim 10, wherein said detecting means comprises a pair of electrodes exposed in said molten metal path and spaced apart from each other, said pair of electrodes being electrically connected by the molten metal flow to obtain the output from said detecting means.

13. A degassing apparatus as defined by claim 10, wherein said detecting means comprises an ultrasonic transmitter/receiver for detecting attenuation of an ultrasonic wave when the molten metal flow passes through said molten metal path.

14. A degassing apparatus as defined by claim 10, wherein said detecting means comprises a pair of coils disposed to be separated from each other to detect a change in magnetic flux when the molten metal flow passes through said molten metal path.

15. A degassing apparatus as defined by claim 10, wherein said detecting means comprises a sensor coil applied with an RF current to detect a change in impedance when the molten metal flow passes through said molten metal path.

16. A degassing apparatus as defined by claim 1, wherein said molding apparatus comprises:

a pair of molds for constituting said cavity;

an injection sleeve incorporated in one of said pair of molds and having a molten metal port;

an injection cylinder for reciprocally driving a plunger fitted in said injection sleeve; and a pneumatic control apparatus responsive to a reciprocal position of said plunger, wherein said pneumatic control apparatus controls a position of said flanged piston in relation to the reciprocal position of said plunger.

17. A degassing apparatus as defined by claim 16, wherein said control apparatus includes a plurality of limit switches in association with the reciprocal position of said plunger.

18. A degassing apparatus as defined by claim 16, wherein said control apparatus comprises a magnetic sensor for generating information associated with the reciprocal position of said plunger.

19. A degassing apparatus as defined by claim 9, further comprising a vacuum suction device connected to said gas outlet opening, wherein when the molten metal is to be injected, said valve arranged midway along said gas outlet path communicating with said cavity is kept in a valve open state by pressurizing said head-side chamber so as to cause said vacuum suction device to exhaust the gas from said cavity through said gas outlet opening; and when said valve is to be closed such that a valve closing force is applied by upward movement of said piston which is caused by a force of a fluid pressure, an initial valve open force in the valve open state is set to be larger than a valve closing force acting on said valve due to vacuum suction at the start of vacuum suction, and the valve open force is set to be smaller than the initial valve open force after a predetermined period of time has elapsed after the start of vacuum suction but before the molten metal reaches said valve.

20. A degassing apparatus as defined by claim 1, further comprising: a valve guide member mounted on the spool, the valve guide member including a bore formed therethrough; and a valve rod mounted on the valve guide member and reciprocatingly slidable within the valve guide bore, the valve rod having opposite axial ends; and wherein said means for selectively controlling the communication and non-communication between the gas inlet and gas outlet openings comprises a valve body mounted on one axial end of the valve rod, the gas inlet opening defining a valve seat, the valve body being adapted to closely engage the valve seat and to form a gas tight seal therewith.

21. A degassing apparatus as defined by claim 20, further including: means for detecting movement of the valve body, the movement detecting means including a through hole formed in the valve guide member and having first and second through hole portions extending radially therethrough and communicating with the valve guide bore;

a fluid passage formed on or in the valve rod, the passage being in communication with the first and second through hole portions when the passage is aligned with the through hole portions;

the through hole being adapted to receive a pressurized fluid on the first portion thereof, the second portion being open to atmospheric pressure, wherein the pressure in the first through hole portion is greater than atmospheric pressure when the through hole portions are in non-alignment with the rod passage, and wherein the first through hole portion is at a reduced pressure when the through hole portions are aligned with the rod passage; and means for detecting a change in the pressure of the through hole, the pressure detecting means being communicatively coupled to the first through hole portion and being responsive to a change in pressure in the through hole to provide a signal indicating the pressure change.

22. In combination:

(a) a degassing apparatus incorporated with a molding apparatus having a mold cavity, which comprises:

a spool having a bore formed therein, the spool further having formed therein a gas inlet opening adapted to be communicatively coupled to the mold cavity of the molding apparatus, and a gas outlet opening, the gas inlet and outlet openings being in selective communication and non-communication with each other;

means for selectively controlling the communication and non-communication between the gas inlet and gas outlet openings; and a flanged piston mounted in the bore and coupled to the communication controlling means, the piston being reciprocatingly slidable between a first position and a second position, the bore being further formed with an upper chamber and a rod-side chamber situated on opposite axial sides of the piston, and a lower chamber radially surrounding a portion of said piston;

the spool further including first, second and third fluid ports formed therein, said ports being in communication with the upper, rod-side and lower chambers respectively, said lower chamber being in communication with said rod-side chamber when said piston is in the second position, wherein the gas inlet and outlet openings are in non-communication, and said lower chamber being in non-communication with said rod-side chamber when said piston is in the first position, wherein the gas inlet and outlet openings are in communication; and (b) means for effecting movement of the piston between the first and second positions, the piston movement effecting means including means for selectively applying a pressurized fluid to at least one of the first, second and third ports.

23. The combination defined by claim 22, wherein the means for selectively applying a pressurized fluid includes a first switching valve and a second switching valve, the first switching valve being coupled to the first port and adapted to selectively provide to the first port at least one of a pressurized fluid and a fluid at atmospheric pressure, the second switching valve being coupled to the second port and being adapted to selectively provide at least one of a pressurized fluid and a fluid at atmospheric pressure.

24. The combination defined by claim 23 further comprising a third switching valve being coupled to the third port and adapted to selectively provide to the third port at least one of a pressurized fluid and a fluid at atmospheric pressure, and being adapted to selectively close the third port to form a substantially gas tight seal therewith.

25. The combination defined by claim 24, wherein the pressurized fluid provided by the second and third switching valves to the second and third ports respectively, is at substantially the same pressure.

26. The combination defined by claim 22, wherein the means for selectively applying a pressurized fluid includes a switching valve coupled to at least one of the first, second and third ports for selectively supplying a pressurized fluid to the respective port, and wherein the means for effecting movement of the piston includes an electronic control circuit, the electronic control circuit being responsive to an electrical control signal indicative of a predetermined event occurring in the operation of the molding apparatus, and providing an output signal to the switching valve, the switching valve being responsive to the output signal from the electronic control circuit to provide the pressurized fluid to the respective port to cause the piston to move in a direction toward one of the first position and the second position

27. The combination defined by claim 26, wherein said electronic control circuit provides an output signal to the third switching valve.

28. A gas-venting arrangement incorporated with a mold including stationary and movable mold portions, together defining a mold cavity to be filled with a molten material, the gas-venting arrangement comprising:

(a) a degassing apparatus, the degassing apparatus including a spool, the spool having a first end portion adapted to be coupled to the molding apparatus, the first end portion of the spool having a gas inlet opening formed therein and adapted to be in communication with the mold cavity, and a gas exhaust hole formed therein, the spool having an inner bore formed therein;

a valve guide member mounted on the spool, the valve guide member including a bore formed therethrough;

a valve rod mounted on the valve guide member and reciprocatingly slidable within the valve guide bore, the valve rod having opposite axial ends;

a valve body mounted on one axial end of the valve rod, the gas inlet opening defining a valve seat, the valve body being adapted to closely engage the valve seat and to form a gas tight seal therewith;

a flanged piston mounted on the other axial end of the valve rod and closely received by the spool inner bore, the piston being reciprocatingly slidable within the inner bore, the piston having opposite first and second axial sides, the inner bore including upper and rod-sided chambers situated on the first and second piston axial sides respectively, and a lower chamber radially surrounding a portion of said piston;

the spool further having formed therein first, second and third fluid ports, being in communication with the upper, rod-side and lower chambers, respectively;

the piston being selectively positionable in a first position, wherein the valve body is disengaged from the valve seat and the rod-side chamber is in non-communication with the lower chamber, and a second position, wherein the valve body closely engages the valve seat and the rod-side chamber is in communication with the lower chamber;

(b) a gas vent groove communicating with the spool bore and formed in said mold to communicate with the mold cavity; and (c) at least one bypass conduit branched from the gas vent groove and selectively in communication with the gas exhaust hole, wherein the bypass conduit and the gas vent groove are in non-communication with the gas exhaust hole when the valve body closely engages the valve seat, and wherein the bypass conduit and the gas vent groove are in communication with the gas exhaust hole when the valve body is disengaged from the valve seat.

29. A degassing apparatus incorporated with a molding apparatus, the molding apparatus having a mold cavity into which a molten material is injected, the degassing apparatus comprising:

a spool, the spool having a first end portion adapted to be coupled to the molding apparatus, said first end portion having a gas inlet opening formed therein and adapted to be in communication with the mold cavity, and a gas exhaust hole formed therein, the spool having an inner bore formed therein;

a valve guide member mounted on the spool, the valve guide member including a bore formed therethrough;

a valve rod mounted on the valve guide member and reciprocatingly slidable within the valve guide bore, the valve rod having opposite axial ends;

a valve body mounted on one axial end of the valve rod, the gas inlet opening defining a valve seat, the valve body being adapted to closely engage the valve seat and to form a gas tight seal therewith; and a flanged piston mounted on the other axial end of the valve rod and closely received by the spool inner bore, the piston being reciprocatingly slidable within the inner bore, the piston having opposite first and second axial sides, the inner bore including upper and rod-sided chambers situated on the first and second piston axial sides respectively, and a lower chamber radially surrounding a portion of said piston;

the spool further having formed therein first, second and third fluid ports, being in communication with the upper, rod-side and lower chambers, respectively;

the piston being selectively positionable in a first position, wherein the valve body is disengaged from the valve seat and the rod-side chamber is in non-communication with the lower chamber, and a second position, wherein the valve body closely engages the valve seat and the rod-side chamber is in communication with the lower chamber.

30. A degassing apparatus as defined by claim 29, wherein partial movement of the piston from the first position toward the second position, effected by molten material impinging the valve body, causes the rod-side chamber and the lower chamber to be in communication.

31. A degassing apparatus incorporated with a molding apparatus, the molding apparatus having a mold cavity into which a molten material is injected, the degassing apparatus comprising:

a spool, the spool having a first end portion adapted to be coupled to the molding apparatus, said first end portion having a gas inlet opening formed therein and adapted to be in communication with the mold cavity, and a gas exhaust hole formed therein, the spool having an inner bore formed therein;

a valve guide member mounted on the spool, the valve guide member including a bore formed therethrough;

a valve rod mounted on the valve guide member and reciprocatingly slidable within the valve guide bore, the valve rod having opposite axial ends;

a valve body mounted on one axial end of the valve rod, the gas inlet opening defining a valve seat, the valve body being adapted to closely engage the valve seat and to form a gas tight seal therewith; and a piston mounted on the other axial end of the valve rod and closely received by the spool inner bore, the piston being reciprocatingly slidable within the inner bore, the piston having opposite first and second axial sides, the inner bore including upper and rod-sided chambers situated on the first and second piston axial sides respectively, and a lower chamber radially surrounding a portion of said piston;

the spool further having formed therein first, second and third fluid ports, being in communication with the upper, rod-side and lower chambers, respectively;

the piston being selectively positionable in a first position, wherein the valve body is disengaged from the valve seat and the rod-side chamber is in non-communication with the lower chamber, and a second position, wherein the valve body closely engages the valve seat and the rod-side chamber is in communication with the lower chamber.

32. A degassing apparatus as defined by claim 31, further comprising:

first means for applying a pressure from said first port to said piston to generate a valve open force, thereby disengaging said valve body from said valve seat; and second means for applying a valve closing force larger than the valve open force from said second port to said piston when a piston side at said lower chamber communicates with said rod-side chamber.

33. A degassing apparatus as defined by claim 31, further comprising:

first means for applying a first pressure on a head-side chamber to generate a valve open force, thereby disengaging said valve body from said valve seat; and second means for applying a second pressure on said lower chamber, said second pressure larger than the first pressure applied to said head-side chamber.

* * * * *